US006647230B2

(12) United States Patent
Kobayashi et al.

(10) Patent No.: US 6,647,230 B2
(45) Date of Patent: Nov. 11, 2003

(54) IMAGE-FORMING APPARATUS FOR USE WITH NEGATIVELY-CHARGED TONER AND FEATURING A NEGATIVELY-CHARGEABLE IMAGE-BEARING MEMBER, AND PROCESS CARTRIDGE USING SAME

(75) Inventors: Tetsuya Kobayashi, Shizuoka (JP); Yasuyuki Ishii, Shizuoka (JP); Tsuyoshi Nakagawa, Tokyo (JP); Shinji Uehara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/942,657

(22) Filed: Aug. 31, 2001

(65) Prior Publication Data

US 2002/0057927 A1 May 16, 2002

(30) Foreign Application Priority Data

Sep. 5, 2000 (JP) ..... 2000-268686
Sep. 5, 2000 (JP) ..... 2000-268687

(51) Int. Cl.[7] ..... G03G 15/00; G03G 15/02
(52) U.S. Cl. ..... 399/159; 430/58.05
(58) Field of Search ..... 399/159, 258, 399/259; 430/58.05

(56) References Cited

U.S. PATENT DOCUMENTS

| | | | | |
|---|---|---|---|---|
| 4,804,991 A | | 2/1989 | Ishizuki et al. | 354/403 |
| 5,206,691 A | | 4/1993 | Mizuno et al. | 355/259 |
| 5,353,104 A | | 10/1994 | Kato et al. | 355/259 |
| 5,486,438 A | * | 1/1996 | Shoshi et al. | 430/58.05 |
| 5,655,197 A | * | 8/1997 | Okada et al. | 399/258 |
| 5,733,702 A | | 3/1998 | Okado et al. | 430/125 |
| 5,853,938 A | | 12/1998 | Nakazawa et al. | 430/110 |
| 5,853,941 A | | 12/1998 | Rimai et al. | 430/122 |

FOREIGN PATENT DOCUMENTS

| | | |
|---|---|---|
| EP | 0 478 317 A2 | 4/1992 |
| EP | 0 844 536 A2 | 5/1998 |
| JP | 62-223711 | 10/1987 |
| JP | 1-239566 | 9/1989 |
| JP | 4-247478 | 9/1992 |

* cited by examiner

*Primary Examiner*—Fred L. Braun
(74) *Attorney, Agent, or Firm*—Fitzpatrick, Cella, Harper & Scinto

(57) ABSTRACT

An image-forming apparatus includes an image-bearing member for holding thereon an electrostatic latent image; a charging device for electrostatically charging a surface of the image-bearing member; an exposure unit for forming the electrostatic latent image on the image-bearing member by exposing to light the image-bearing member having been charged by the charging device; and a developing unit which has at least a toner-carrying member for carrying and transporting a negatively-chargeable toner thereon and developing the electrostatic latent image by a contact developing system to form a toner image. In the triboelectric series relationship between the toner and a surface layer of the image-bearing member, the surface layer of the image-bearing member has a charge polarity which is a different polarity with respect to the charge polarity of the toner in the developing unit. The image-bearing member includes the electrostatic latent image including a surface potential, as a nonimage area potential (Vd) within a range of −500 to −800 V, and as an image area potential (Vl), at which the maximum toner image density is to be obtained, within a range of −50 to −200 V. A process cartridge includes the above-described image-bearing member.

79 Claims, 10 Drawing Sheets

IMAGE-FORMING APPARATUS FOR USE WITH NEGATIVELY-CHARGED TONER AND FEATURING A NEGATIVELY-CHARGEABLE IMAGE-BEARING MEMBER, AND PROCESS CARTRIDGE USING SAME

BACKGROUND OF THE INVENTION

1. Field of the Invention

This invention relates to an image-forming apparatus employing an electrophotographic recording system having an exposure unit which radiates light modulated in accordance with image signals and a contact developing unit for developing electrostatic latent images formed by this exposure unit. More particularly, this invention relates to an image-forming apparatus which can prevent mismatching in the expression of density gradation and spots around line images from being caused by the shortage of charge quantity due to reversely charged toner. This invention also relates to a process cartridge used in the image-forming apparatus.

2. Related Background Art

In general, image-forming apparatus employing an electrophotographic recording system have a photosensitive member which is rotatively driven, a charging assembly which electrostatically charges the surface of the photosensitive member uniformly, an exposure means by which the surface of the photosensitive member is exposed to form an electrostatic latent image corresponding to image signals, a developing means by which the electrostatic latent image is developed with a toner to form a visible image, a transfer means by which the visible image is transferred onto recording paper, and a fixing means by which the visible image transferred onto the recording paper is fixed.

In this case, as the developing means, two types are known in which a developing roller comes into contact with the photosensitive member to perform development (hereinafter called a contact developing system) and the developing roller performs development in a state of noncontact with the photosensitive member (hereinafter called a noncontact developing system). The contact developing system includes a type in which, as disclosed in Japanese Patent Applications Laid-Open No. 62-223711 and No. 1-239566, the developing roller is elastically brought into contact with the surface of the photosensitive member and a type in which, as disclosed in Japanese Patent Applications Laid-Open No. 4-247478, as the developing roller a roller comprised of an elastic member is provided with a resin thin-sheet sleeve on its surface.

FIG. 4 is a diagrammatic cross-sectional view showing the construction of an example of a known image-forming apparatus employing as the developing means the contact developing system (hereinafter this apparatus is called a conventional apparatus).

In FIG. 4, reference numeral 101 denotes a drum-shaped photosensitive member (photosensitive drum); 102, a contact developing roller; 103, a developing unit; 104, a transfer roller; 105, a charging roller; 106, an exposure means; 108, a toner feed roller; 109, a developing blade; and 110, a toner.

The photosensitive drum 101 is constituted of a drum-shaped metallic crude pipe and a photosensitive material applied to its surface. When operated, it is rotatively driven around a rotating shaft in the direction of an arrow shown in the drawing, by means of a drive unit (not shown). The developing roller 102 and the developing unit 103 constitute the developing means. The developing roller 102 is so constructed and disposed as to be always in contact with the surface of the photosensitive drum 101 and rotatable with the rotation of the photosensitive drum 101. The developing unit 103 has a developing blade 109 so constructed as to come into touch with the developing roller 102. The toner 110 is made to pass the part of the developing blade 109 touching the developing roller 102, and the quantity of the toner 110 carried on the developing roller 102 is regulated to form a thin layer of the toner 110 on the developing roller 102. At the same time, the friction caused at the touching part imparts a sufficient triboelectric charges (triboelectricity) to the toner 110. Also, in the developing unit 103, the toner feed roller 108, coming into contact with the developing roller 102, is provided at a position which is on the upstream side of the developing blade 109 in the direction of the rotation of the developing roller 102, to feed the toner 110 to the developing roller 102 so as to be carried thereon.

The transfer roller 104 constitutes the transfer means, and is so constructed that it is rotated in contact with the photosensitive drum 101 and the recording paper (not shown) passes the contact zone formed between the photosensitive drum 101 and the transfer roller 104 at the time of transfer.

The charging roller 105 electrostatically charges the surface of the photosensitive drum 101 uniformly at a constant potential by means of a charge voltage generation power source (not shown). It is kept in pressure contact with the surface of the photosensitive drum 101 at a stated pressure to electrostatically charges the surface of the photosensitive drum 101 while being rotated with the rotation of the photosensitive drum 101.

The exposure means 106 feeds light signals modulated in accordance with image signals sent from an image signal source (not shown). It provides the surface of the photosensitive drum 101 with the light signals to form thereon an electrostatic latent image corresponding to the image signals.

How the conventional apparatus is operated is described below. To describe the whole operation of the conventional apparatus, the photosensitive drum 101 rotated in the direction of an arrow a shown in FIG. 4 is first uniformly charged on its surface by means of the charging roller 105, and then an electrostatic latent image corresponding to image signals is formed on its surface by means of the exposure means 106. Subsequently, the electrostatic latent image is developed by making the toner 110 adhere thereto by means of the developing roller 102 to which development voltage has been applied from the charge voltage generation power source (not shown), so that a visible image corresponding to this electrostatic latent image is formed on the surface of the photosensitive drum 101. This visible image formed on the surface of the photosensitive drum 101 is transferred onto the recording paper by means of the transfer roller 104. The visible image thus transferred is fixed onto the recording paper and thereafter taken out as a recorded image together with the recording paper. Meanwhile, the surface part of the photosensitive drum 101 having passed the part of the transfer roller 104 is cleaned to remove the toner through a cleaning means (not shown). Then, the process described above is again carried out repeatedly.

The construction of a photosensitive layer of the photosensitive drum 101 is roughly grouped into a single layer type containing both a charge-generating material and a charge-transporting material in the same layer and a multilayer type having a charge generation layer containing a charge-generating material and a charge transport layer containing a charge-transporting material.

An electrophotographic photosensitive member having the photosensitive layer of a multilayer type includes a photosensitive member comprising a substrate and superposed thereon the charge generation layer and the charge transport layer in this order. The charge transport layer is formed by applying a solution prepared by dissolving in a resin having film-forming properties a charge-transporting material including polycyclic aromatic compounds having a structure such as a biphenylene, anthracene, pyrene or phenanthrene structure in the main chain or side chain; nitrogen-containing ring compounds such as indole, carbazole, oxazole and pyrazoline; hydrazone compounds and styryl compounds; followed by drying. The resin having film-forming properties may include polyester, polycarbonate, polystyrene, polymethacrylate and polyarylate. The charge generation layer is formed by coating the substrate with a dispersion prepared by dispersing in a resin such as polyvinyl butyral, polystyrene, polyvinyl acetate or acrylic resin a charge-generating material including azo pigments such as Sudan Red and Diamond Blue, quinone pigments such as pyrene, quinone and anthanthrone, quinocyanine pigments, perylene pigments, indigo pigments such as indigo and thioindigo, and phthalocyanine pigments, followed by drying, or by vacuum depositing any of the above pigments on the substrate.

As for the photosensitive layer of a single-layer type, it is formed by coating the substrate with a solution prepared by dispersing or dissolving the above charge-generating material and charge-transporting material, followed by drying.

As a method of expressing density gradation in electrophotographic image-forming apparatus, widely known are a gradation expression in which light is radiated from a light source on an original and the latent-image potential on a photosensitive drum is made variable in accordance with the quantity of light reflecting therefrom (an electrostatic latent image thus formed is hereinafter called an analogue latent image), and a gradation expression in which a photosensitive drum is exposed to light modulated in accordance with image signals, emitted from an exposure unit, and its exposure area is made variable (an electrostatic latent image thus formed is hereinafter called a digital latent image). Where the contact developing system is used to develop these electrostatic latent images, density gradation characteristics may greatly deviate depending on the quantity of triboelectricity of a toner.

FIG. 5 shows density gradation characteristics with respect to analogue latent images where the quantity of triboelectricity of a toner differs. In FIG. 5, a curve shown by solid-black plot marks indicates a case in which the toner has proper quantity of triboelectricity; and a curve shown by solid-white plot marks, a case in which the toner has decreased in quantity of triboelectricity. As shown in FIG. 5, where the toner has decreased in quantity of triboelectricity, the density (image density) rises abruptly from a low contrast potential and the density becomes kept saturated even when the contrast potential is made higher. On the other hand, where the toner has a proper quantity of triboelectricity, density gradation characteristics are obtained in accord with the contrast potential. This is a phenomenon caused by a difference in mirror image force on the developing roller due to a difference in toner's triboelectricity. It is presumed that the toner decreased in the quantity of triboelectricity has so weak a mirror image force to the developing roller as to become subject to the force given from an electric field formed between the photosensitive drum and the developing roller, so that the toner tends to move easily to the photosensitive drum even at a low contrast potential. The toner's triboelectricity may considerably vary depending on how long the toner is used and how many times it is used. Thus, it can be said that the density gradation characteristics in the contact developing system come out against the analogue latent images.

Then, FIG. 6 shows density gradation characteristics with respect to digital latent images where the quantity of triboelectricity of a toner differs. In FIG. 6, a curve shown by solid-black plot marks indicates a case in which the toner has a proper quantity of triboelectricity; a curve shown by solid-white plot marks, a case in which the toner has decreased in the quantity of triboelectricity; and a solid line, ideal density gradation characteristics. As shown in FIG. 6, compared with the density gradation characteristics concerning the analogue latent images, substantially good density gradation characteristics are obtained even where the toner has decreased in a quantity of triboelectricity, thus the digital latent images are preferable for the contact developing system. This difference in density gradation characteristics of digital latent images is a difference in density of electrostatic latent images formed at the high contrast potentials shown in FIG. 5. It is presumed that the density is substantially equally outputted in either of the toner with a low quantity of triboelectricity and the toner with a proper quantity of triboelectricity, and hence, compared with the case of analogue latent images, the difference in the density gradation characteristics due to the difference in the quantity of triboelectricity is less in the case of digital latent images.

However, as shown in FIG. 6, where the toner has a low quantity of triboelectricity, the density gradation characteristics shift at a higher density than the ideal density gradation characteristics even at a light gradation. Hence, in the formation of images like photographic images, too dense images may be formed as a whole, and the images may look dark and dull. The same applies also to a case in which line images as typified by characters or letters are formed. When the toner has a low quantity of triboelectricity, the toner may move in excess to line-image latent images to cause an increase in height of toner images on the photosensitive drum, resulting in an increase in toner consumption and causing a faulty image called toner spots around line images.

Accordingly, in the contact developing system, in order to maintain good density gradation characteristics and prevent the toner consumption from increasing, the quantity of triboelectricity must be kept from lowering.

In the contact developing system, however, the toner is regulated by the developing blade to have a prescribed toner layer thickness and at the same time provided with a stated quantity of triboelectricity. When the surface of the photosensitive drum (an image-bearing member which holds thereon the electrostatic latent image) is rubbed with the toner, the quantity of triboelectricity may become lower than a prescribed value or a toner charged to a reverse polarity may be formed, if the relation of triboelectric series of the photosensitive drum surface layer with respect to the toner is the same polarity as that of the toner. Then, the lowering of the quantity of triboelectricity of the toner is accelerated because the number of times of its friction with the photosensitive drum increases with times the developing unit as used. As the result, even though the toner has a proper quantity of triboelectricity at the initial stage, it becomes a toner having a low quantity of triboelectricity to cause problems such as crushed line images, spots around line images and an increase in toner consumption. Moreover, the toner charged in a reverse polarity may adhere to nonimage areas on the photosensitive drum to appear as reversal fog, also causing such a problem that the toner consumption increases.

SUMMARY OF THE INVENTION

An object of the present invention is to provide an image-forming apparatus having solved the above problems. That is, an object of the present invention is to provide an image-forming apparatus which can prevent the toner's quantity of triboelectricity from lowering in the contact developing system, and can well maintain the density gradation characteristics to form images (visible toner images) stably in the step of developing electrostatic latent images formed by exposing a photosensitive drum to light modulated in accordance with image signals which is emitted from an exposure unit while varying its exposure area.

Another object of the present invention is to provide an image-forming apparatus which can prevent any excess toner consumption.

Still another object of the present invention is to provide an image-forming apparatus which can be free of any reversal fog even in its long-term continuous service.

The present invention provides an image-forming apparatus comprising:

an image-bearing member for holding thereon an electrostatic latent image;

a charging means for charging the surface of the image-bearing member electrostatically;

an exposure unit for forming the electrostatic latent image on the image-bearing member by exposing to light the image-bearing member having been charged by the charging means; and a developing unit which has at least a toner-carrying member for carrying and transporting a toner thereon; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein, in the triboelectric series relationship between the toner and a surface layer of the image-bearing member, the surface layer of the image-bearing member has a charge polarity which is a different polarity with respect to the charge polarity of the toner in the developing unit.

The present invention also provides an image-forming apparatus comprising:

an image-bearing member for holding thereon an electrostatic latent image;

a charging means for charging the surface of the image-bearing member electrostatically;

an exposure unit for forming the electrostatic latent image on the image-bearing member by exposing to light the image-bearing member having been charged by the charging means; and a plurality of developing units for developing electrostatic latent images with toners having different colors;

wherein;

the developing units each have at least a toner-carrying member for carrying and transporting thereon a toner having different color; the toner-carrying member of one developing unit selected from the developing units being brought into contact with the image-bearing member to form a developing zone, and in the developing zone the toner being made to adhere electrically to the electrostatic latent image formed on the image-bearing member, to render the electrostatic latent image visible; these steps being sequentially repeated for each of the remaining developing units to form toner images; and in the triboelectric series relationship between each toner and a surface layer of the image-bearing member, the surface layer of the image-bearing member has a charge polarity which is a different polarity with respect to the charge polarity of each toner in the developing unit.

The present invention still also provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, followed by fixing; the process cartridge comprising:

the image-bearing member for holding thereon the electrostatic latent image;

a developing unit which has at least a toner-carrying member for carrying and transporting a toner thereon; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

in the triboelectric series relationship between the toner and a surface layer of the image-bearing member, the surface layer of the image-bearing member having a charge polarity which is a different polarity with respect to the charge polarity of the toner in the developing unit.

The present invention further provides an image-forming apparatus comprising:

an image-bearing member for holding thereon an electrostatic latent image;

an exposure unit for forming the electrostatic latent image on the image-bearing member by exposing the image-bearing member to light; and a developing unit which has at least a toner-carrying member for carrying and transporting thereon a negatively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein the triboelectric series relationship between a surface layer of the image-bearing member, the toner particles and the external additive is in the order of the external additive, the toner particles and the surface layer of the image-bearing member from the negative side.

The present invention still further provides an image-forming apparatus comprising:

an image-bearing member for holding thereon an electrostatic latent image;

an exposure unit for forming the electrostatic latent image on the image-bearing member by exposing the image-bearing member to light; and a developing unit which has at least a toner-carrying member for carrying and transporting thereon a negatively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein the triboelectric series relationship between a surface layer of the image-bearing member, the toner particles and the external additive is in the order of the toner particles, the external additive and the surface layer of the image-bearing member from the negative side.

The present invention still further provides an image-forming apparatus comprising:

an image-bearing member for holding thereon an electrostatic latent image;

an exposure unit for forming the electrostatic latent image on the image-bearing member by exposing the image-bearing member to light; and a developing unit which has at least a toner-carrying member for carrying and transporting thereon a negatively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein the triboelectric series relationship between a surface layer of the image-bearing member, the toner particles and the external additive is in the order of the toner particles, the surface layer of the image-bearing member and the external additive from the negative side.

The present invention still further provides an image-forming apparatus comprising:

an image-bearing member for holding thereon an electrostatic latent image;

an exposure unit for forming the electrostatic latent image on the image-bearing member by exposing the image-bearing member to light; and a developing unit which has at least a toner-carrying member for carrying and transporting thereon a positively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein the triboelectric series relationship between a surface layer of the image-bearing member, the toner particles and the external additive is in the order of the external additive, the toner particles and the surface layer of the image-bearing member from the positive side.

The present invention still further provides an image-forming apparatus comprising:

an image-bearing member for holding thereon an electrostatic latent image;

an exposure unit for forming the electrostatic latent image on the image-bearing member by exposing the image-bearing member to light; and a developing unit which has at least a toner-carrying member for carrying and transporting thereon a positively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein the triboelectric series relationship between a surface layer of the image-bearing member, the toner particles and the external additive is in the order of the toner particles, the external additive and the surface layer of the image-bearing member from the positive side.

The present invention still further provides an image-forming apparatus comprising:

an image-bearing member for holding thereon an electrostatic latent image;

an exposure unit for forming the electrostatic latent image on the image-bearing member by exposing the image-bearing member to light; and a developing unit which has at least a toner-carrying member for carrying and transporting thereon a positively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image;

wherein the triboelectric series relationship between a surface layer of the image-bearing member, the toner particles and the external additive is in the order of the toner particles, the surface layer of the image-bearing member and the external additive from the positive side.

The present invention still further provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, followed by fixing; the process cartridge comprising:

the image-bearing member for holding thereon the electrostatic latent image;

a developing unit which has at least a toner-carrying member for carrying and transporting thereon a negatively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

the triboelectric series relationship between a surface layer of the image-bearing member, the toner particles and the external additive being in the order of the external additive, the toner particles and the surface layer of the image-bearing member from the negative side.

The present invention still further provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, followed by fixing; the process cartridge comprising:

the image-bearing member for holding thereon the electrostatic latent image;

a developing unit which has at least a toner-carrying member for carrying and transporting thereon a negatively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

the triboelectric series relationship between a surface layer of the image-bearing member, the toner particles and the external additive being in the order of the toner particles, the external additive and the surface layer of the image-bearing member from the negative side.

The present invention still further provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, followed by fixing; the process cartridge comprising:

the image-bearing member for holding thereon the electrostatic latent image;

a developing unit which has at least a toner-carrying member for carrying and transporting thereon a negatively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

the triboelectric series relationship between a surface layer of the image-bearing member, the toner particles and the external additive being in the order of the toner particles, the surface layer of the image-bearing member and the external additive from the negative side.

The present invention still further provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, followed by fixing; the process cartridge comprising:

the image-bearing member for holding thereon the electrostatic latent image;

a developing unit which has at least a toner-carrying member for carrying and transporting thereon a positively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

the triboelectric series relationship between a surface layer of the image-bearing member, the toner particles and the external additive being in the order of the external additive, the toner particles and the surface layer of the image-bearing member from the positive side.

The present invention still further provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, following by fixing; the process cartridge comprising:

the image-bearing member for holding thereon the electrostatic latent image;

a developing unit which has at least a toner-carrying member for carrying and transporting thereon a positively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

the triboelectric series relationship between a surface layer of the image-bearing member, the toner particles and the external additive being in the order of the toner particles, the external additive and the surface layer of the image-bearing member from the positive side.

The present invention still further provides a process cartridge which is detachably mountable to the main body of an image-forming apparatus for forming a fixed image by developing with a toner an electrostatic latent image formed on an image-bearing member to form a toner image, and transferring the toner image to a transfer medium either via an intermediate transfer member or directly transferring the toner image to a transfer member without using an intermediate transfer member, followed by fixing; the process cartridge comprising:

the image-bearing member for holding thereon the electrostatic latent image;

a developing unit which has at least a toner-carrying member for carrying and transporting thereon a positively chargeable toner having toner particles and at least one external additive; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image; and none or at least one of means selected from the group consisting of:

(a) a charging means for charging the surface of the image-bearing member electrostatically;

(b) an exposure unit for forming the electrostatic latent image on the image-bearing member by exposing to light the image-bearing member having been charged by the charging means;

(c) a transfer means for transferring the toner image formed by the developing unit, to the transfer medium either via the intermediate transfer member or directly transferring the toner image to a transfer member without using an intermediate transfer member; and (d) a cleaning means for removing a toner remaining on the image-bearing member after the toner image has been transferred to the transfer medium; and being supported integrally together with the image-bearing member and the developing unit;

the triboelectric series relationship between a surface layer of the image-bearing member, the toner particles and the external additive being in the order of the toner particles, the surface layer of the image-bearing member and the external additive from the positive side.

DESCRIPTION OF THE PREFERRED EMBODIMENTS

Figure 1:
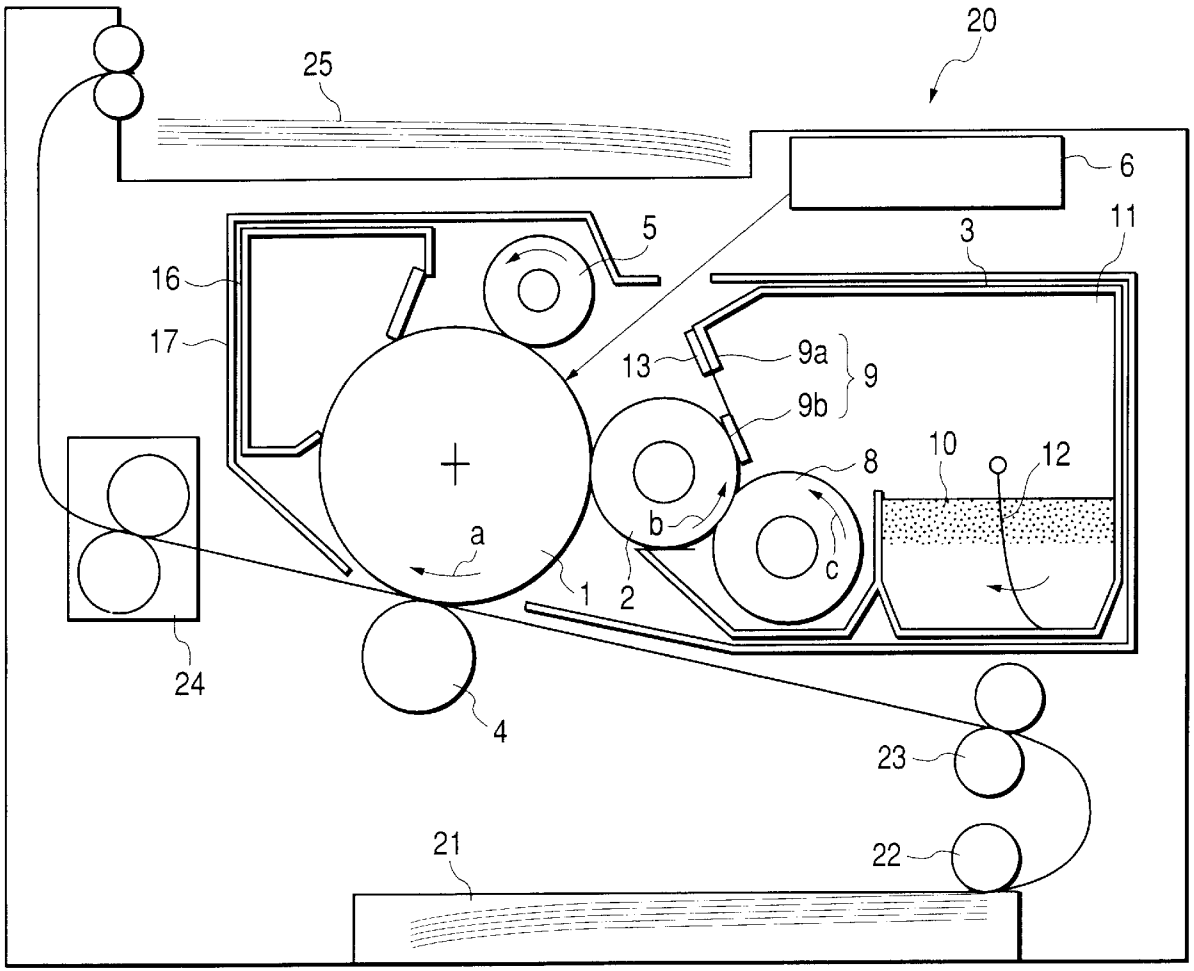
FIG. 1 is a schematic illustration of the construction of an example of the image-forming apparatus of the present invention.

To solve the problems discussed above, the present inventors took note of the relation between toners and surface layers of image-bearing members in the triboelectric series, and have discovered that an image-forming apparatus which can well maintain density gradation characteristics in the step of development and can form images free of any reversal fog can be obtained when a toner and an image-bearing member having a specific relationship in the triboelectric series are used in combination. Thus, they have accomplished the present invention.

The toner used in the present invention is described below. As the toner used in the present invention, a nonmagnetic, one-component developer (toner) is preferred. This nonmagnetic, one-component developer (toner) may include a toner having minus charging polarity (hereinafter often "negatively chargeable toner") and a toner having plus charging polarity (hereinafter often "positively chargeable toner"). The toner may preferably have toner particles and at least one external additive. The negatively chargeable toner is a toner which is negatively electrostatically charged upon its friction with a developing blade or a developing roller, and is positioned on the negative side in the triboelectric series. On the other hand, the positively chargeable toner is a toner which is positively electrostatically charged upon its friction with a developing blade or a developing roller, and is positioned on the positive side in the triboelectric series. The triboelectric chargeability of the toner and toner particles in the present invention depends on the combination of a binder resin, a colorant and a charge control agent which constitute the toner, and on the content and so forth of each material.

The binder resin used in the toner or toner particles in the present invention may include polystyrene, poly-α-methylstyrene, a styrene-propylene copolymer, a styrene-butadiene copolymer, a styrene-vinyl chloride copolymer, a styrene-vinyl acetate copolymer, a styrene-acrylate copolymer, a styrene-methacrylate copolymer, vinyl chloride resins, polyester resins, epoxy resins, phenol resins and polyurethane resins, any of which may be used alone or in combination. In particular, a styrene-acrylate copolymer, a styrene-methacrylate copolymer and polyester resins are preferred.

As the colorant used in the toner of the present invention, known colorants may be used. For example, it may include carbon black; oil-soluble dyes such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, C.I. Vat Red 1, 2, 10, 13, 15, 23, 29, 35, C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28; C.I. Pigment Blue 2, 3, 15, 16, 17; C.I. Vat Blue 6; C.I. Acid Blue 45, or copper phthalocyanine pigments whose phthalocyanine skeleton has been substituted with 1 to 5 phthalimide methyl group(s); C.I. Pigment Yellow 1, 2, 3, 4, 5, 6, 7, 10, 11, 12, 13, 14, 15, 16, 17, 23, 65, 73, 83; and C.I. vat Yellow 1, 3, 20. Any of these may be used alone or in the form of a mixture.

The colorant may be used in an amount of from 0.1 to 60 parts by weight, and preferably from 0.5 to 50 parts by weight, based on 100 parts by weight of the binder resin.

The charge control agent may include the following.

As charge control agents used when the toner used in the present invention is controlled to be of minus charging polarity (i.e., negatively charging charge control agents), organic metal complexes or chelate compounds are effective, which include monoazo metal complexes, acetylacetone metal complexes, and metal complexes of an aromatic hydroxycarboxylic acid type or aromatic dicarboxylic acid type. In addition, they include aromatic hydroxycarboxylic acid, aromatic mono or polycarboxylic acids and metal salts thereof, anhydrides thereof or esters thereof, and phenol derivatives such as bisphenol.

As for charge control agents used when the toner used in the present invention is controlled to be of plus charging polarity (i.e., positively charging charge control agents), usable are Nigrosine dyes; Nigrosine-modified products, modified with a fatty acid metal salt; quaternary ammonium salts such as tributylbenzylammonium 1-hydroxy-4-naphthosulfonate and tetrabutylammonium teterafluoroborate, and analogues of these, including onium salts thereof such as phosphonium salts, and lake pigments thereof; triphenyl methane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); amine and polyamine compounds; metal salts of higher fatty acid; acetylacetone metal complexes; diorganotin oxides such as dibutyltin oxide, dioctyltin oxide and dicyclohexyltin oxide; and diorganotin borates such as dibutyltin borate, dioctyltin borate and dicyclohexyltin borate. In using either of the negatively charging charge control agents and the positively charging charge control agents, any of these may be used in an amount of from 0.1 to 15 parts by weight, and preferably from 0.5 to 10 parts by weight, based on 100 parts by weight of the binder resin.

A release agent may optionally be added to the toner used in the present invention. For example, it may include aliphatic hydrocarbon waxes or oxides thereof such as low-molecular weight polyethylene, low-molecular weight polypropylene, paraffin wax and Fischer-Tropsh wax; waxes composed chiefly of a fatty ester, such as carnauba wax and montanic acid ester wax, or those obtained by subjecting part or the whole thereof to deoxydation treatment. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty amides such as linolic acid amide; saturated fatty bisamides such as methylenebis(stearic acid amide); unsaturated fatty bisamides such as ethylenebis(oleic acid amide); aromatic bisamides such as N,N'-distearylisophthalic acid amide; fatty metal salts such as zinc stearate; grafted waxes obtained by grafting vinyl monomers such as styrene to aliphatic hydrocarbon waxes; partially esterified products of polyhydric alcohols with fatty acids, such as monoglyceride behenate; and methyl esterified product having a hydroxyl group, obtained by hydrogenation of vegetable fats and oils. The release agent may be added in an amount of from 0.1 to 20 parts by weight, and preferably from 0.5 to 10 parts by weight, based on 100 parts by weight of the binder resin.

The toner used in the present invention may be produced by a process in which the above materials are melt-kneaded and the kneaded product obtained is dried and then pulverized; a process in which the constituent materials are dispersed in a solution of the binder resin, followed by spray drying to obtain a toner; or a polymerization process in which stated materials are mixed in monomers which are to constitute the binder resin to form an emulsion suspension, followed by polymerization to obtain a toner.

The toner used in the present invention may be used with external addition of inorganic fine powder such as fine silica powder, fine aluminum powder or fine titanium powder to the toner particles. The inorganic fine powder may preferably have a BET specific surface area of from 20 $m^2/g$ to 400 $m^2/g$. A surface-treated product of the inorganic fine powder may also externally be added. As a surface treating agent, it may include silane coupling agents, titanium coupling agents and silicone oils. The inorganic fine powder may preferably be those treated with a silane coupling agent or a silicone oil. The inorganic fine powder may be surface-treated with both a silane coupling agent and a silicone oil. The above inorganic fine powder may be added to the toner in an amount of from 0.05 to 5 parts by weight, and more preferably from 0.1 to 3 parts by weight, based on 100 parts by weight of the toner particles.

Image-forming Apparatus

First Embodiment

A first embodiment of the image-forming apparatus of the present invention which makes use of the toner described above is described below. The image-forming apparatus of the present invention has at least:

- an image-bearing member for holding thereon an electrostatic latent image;
- a charging means for charging the surface of the image-bearing member electrostatically;
- an exposure unit for forming the electrostatic latent image on the image-bearing member by exposing the image-bearing member having been charged by the charging means, to light having been modulated in accordance with image signals;
- and a developing unit which has at least a toner-carrying member for carrying the toner thereon and transporting it to the image-bearing member; the toner-carrying member being brought into contact with the image-bearing member to form a developing zone, and in the developing zone the toner being made to adhere electrically to the electrostatic latent image formed on the image-bearing member, to render the electrostatic latent image visible to form a toner image.

FIG. 1 is a schematic illustration of the construction of an example of the image-forming apparatus of the present invention. The image-forming apparatus of the present invention has a photosensitive drum 1 as an image-bearing member for holding thereon an electrostatic latent image, a charging roller as a charging means for charging the surface of the photosensitive drum electrostatically, a laser scanner 6 as an exposure unit for forming the electrostatic latent image on the photosensitive drum 1, a developing unit 3 for developing the electrostatic latent image formed by this laser scanner 6, to form a toner image, a transfer roller 4 as a transfer means for transferring this toner image to a transfer medium, and a cleaning unit 17 for collecting any toner remaining on the photosensitive drum 1 after the transfer of the toner image has been performed by the transfer roller 4.

Figure 2:
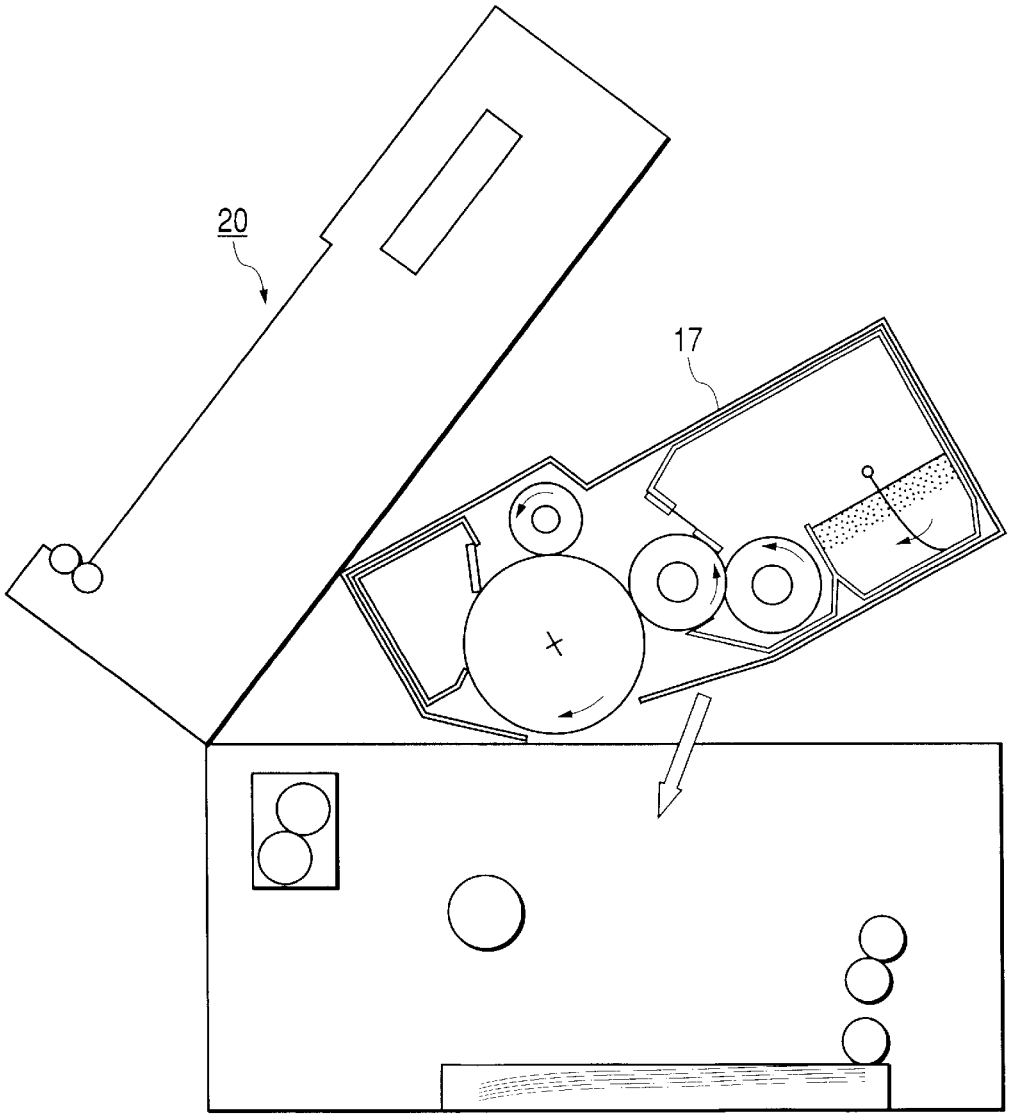
FIG. 2 is a schematic illustration of how a process cartridge is mounted on the image-forming apparatus of the present invention.

The developing unit 3 is used to develop the electrostatic latent image formed on the photosensitive drum 1. In the present embodiment, the photosensitive drum 1 and the developing unit 3 are set as a process cartridge detachably mountable to the main body of the image-forming apparatus as shown in FIG. 2, but may be of a stationarily installed type. The laser scanner 6 as the exposure unit exposes the surface of the photosensitive drum 1 to laser light having been ON/OFF-controlled (modulated) in accordance with image signals inputted to the image-forming apparatus or produced in the interior of the apparatus main body, like a test pattern, and forms the electrostatic latent image on the photosensitive drum 1. The exposure unit used in the present invention is by no means limited to the laser scanner, and an exposure unit of an LED print head system or a liquid-crystal shutter array system may also be used.

As a means for modulating the image signals, it is preferable to use multilevel area methods such as a laser light intensity modulation or error-scattering method and a dithering method. Also, these may be used in combination. It is also preferable to perform multilevel recording by a single-pixel multilevel area method using a PWM (pulse-width modulation) system. Image signals may be changed at a 256 gradation level of from 00h (white) to FF (black).

When the negatively chargeable toner is used, the photosensitive drum 1 may preferably have a surface potential, as nonimage area potential (Vd), within the range of from −500 to −800 V, and, as image area potential (Vl) at which the maximum toner image density is to be obtained, within the range of from −50 to −200 V. Similarly, when the positively chargeable toner is used, it may preferably have a surface potential, as nonimage area potential (Vd), within the range of from +500 to +800 V, and, as image area potential (Vl) at which the maximum toner image density is to be obtained, within the range of from +50 to +200 V.

The developing unit 3 is, as shown in FIG. 1, so constructed as to have a developing container 11 holding therein a one-component developer, nonmagnetic toner 10, a developing roller 2, a developing blade 9, a toner feed roller 8 and an agitation blade 12.

The developing roller 2 has multilayer construction in which a cylindrical member made of a metal such as aluminum, an alloy thereof or stainless steel is provided on its periphery with an elastic layer consisting of a base layer and its upper layer. The base layer of the elastic layer is formed of a rubber such as butadiene-acrylonitrile rubber (nitrile-butadiene rubber, NBR), ethylene-propylene-diene polyethylene (EPDM), silicone rubber or urethane rubber, and the surface layer is formed of ether urethane or nylon. Without limitation to these materials, it may also have construction in which a foam such as sponge is used in the base layer and a rubber elastic layer is formed as the surface layer. It may also have a structure of single-layer construction in which the elastic layer is constituted only of a rubber elastic layer such as an NBR, EPDM or urethane rubber layer. In the present embodiment, the developing roller 2 is rotatively driven in the direction of an arrow b shown in FIG. 1, by means of a developing roller drive source (not shown).

The developing blade 9, which is a toner regulation member, is supported on a hold-down plate 13 above the developing roller 2, and is so provided that the vicinity of an end on its free-end side comes into touch with the periphery of the developing roller 2 in the sate of face-to-face contact. The direction of touch of the developing blade 9 is the counter direction in which its leading end side is positioned on the upstream side to the direction of rotation of the developing roller 2 with respect to the touching part.

In the present embodiment, the developing blade 9 comprises as a thin metal sheet 9*a* a phosphor bronze sheet having spring elasticity, and as an elastic member 9*b* a polyamide elastomer formed thereon by bonding or injection molding. It is kept in touch with the surface of the developing roller 2 on the side of its elastic member 9*b* at a stated linear pressure. The thin metal sheet 9*a* maintains the force of pressure touch of the developing blade against the developing roller 2, where chargeability is imparted to the toner 10 by the polyamide elastomer when the toner 10 is, e.g., the negatively chargeable toner. The thin metal sheet 9*a* may be any of those capable of maintaining the force of pressure touch of the developing blade, without any particular limitations. The elastic member 9*b* may also be selected taking account of the chargeability of the toner. Also, a member for providing charge to the toner, such as the elastic member 9*b*, need not especially be provided. The thin metal sheet 9*a*, having spring elasticity, such as a thin stainless steel sheet or a thin phosphor bronze sheet itself may be used, and such a thin metal sheet 9*a* may be brought into touch with the developing roller 2 via the toner. Such construction may be used.

The toner feed roller 8 may preferably be of sponge structure, or fur brush structure in which fibers such as Rayon or nylon fibers have been set on a mandrel. Such a roller is preferred in view of the feeding of the toner to the developing roller 2 and the stripping of the toner remaining after development. In the present embodiment, an elastic roller is used which comprises a mandrel and a urethane foam provided thereon. The toner feed roller 8 constituted of this elastic roller is kept in contact with the developing roller 2 and is rotated in the direction of an arrow c, the same direction of rotation as the developing roller 2.

When the electrostatic latent image formed on the photosensitive drum 1 is developed with the toner, a development high voltage which is a development bias voltage is applied to the developing roller 2. The development high voltage is direct-current voltage. As conditions for the development high voltage applied when the electrostatic latent image formed under the above conditions is developed, the contrast potential |Vl−Vdc| (Vcont) which corresponds to the potential difference between the development high voltage (Vdc) and the image area potential (Vl) at which the maximum toner image density is to be obtained may preferably be within the range of from 50 to 400 V.

In addition, since the toner carried on the developing roller 2 is the nonmagnetic, one-component developer (toner), the forces which bind the toner on the developing roller 2 are only the mirror image force attributable to electric charges the toner has and the van der Waals force acting slightly. Hence, the mirror force acting on the toner present on the upper-layer part of the toner layer becomes weak with an increase in the thickness of the toner layer, so that the toner may come not to be carried on the developing roller 2 to tend to scatter. Accordingly, the toner layer on the developing roller 2 must be regulated to be thin. As a result, however, a sufficient image density is difficult to attain in some cases. In such a case, the image density can be ensured by setting the peripheral speed of the developing roller 2 higher than the peripheral speed of the photosensitive drum 1. As their peripheral speed ratio, the peripheral speed of the developing roller 2 may preferably be set at 1.1 to 3 times the peripheral speed of the photosensitive drum 1.

The image-forming apparatus of the present invention is characterized in that, in the triboelectric series relation between the toner and the surface layer of the photosensitive drum 1 as the image-bearing member, the surface layer of the photosensitive drum 1 has a charge polarity opposite to the charge polarity of the toner. In the triboelectric series relationship, the surface layer of the photosensitive drum 1 is so controlled as to have a different polarity with respect to the charge polarity of the toner, so that the toner can be maintained at the regular charge polarity and the toner's triboelectricity can be prevented from lowering, even when the toner is rubbed with the image-bearing member surface in the contact developing system. As a result, the density gradation characteristics can be maintained in a good condition. The toner can also be prevented from moving in excess to line-image latent images, and hence the toner consumption can be prevented from increasing and at the same time the spots around line images can be prevented from occurring.

The photosensitive drum 1 as the image-bearing member used in the image-forming apparatus is described below. The photosensitive drum 1 used in the present invention is so constructed that any necessary functional layer(s) and a photosensitive layer consisting of a charge generation layer containing a charge-generating material and a charge transport layer containing a charge-transporting material are superposed on a conductive substrate. As examples of materials for the conductive substrate, they may include metals such as aluminum, copper, nickel and silver, or alloys of these; and molded materials of mixtures of conductive metal oxides such as antimony oxide, indium oxide and tin oxide, carbon fibers, carbon black or graphite powder with resins.

To cover any defects on the conductive substrate or to protect the conductive substrate, a conductive layer may be provided on the conductive substrate. For example, it may be formed by applying to the substrate a dispersion prepared by dispersing a metal powder such as aluminum, copper, nickel or silver powder; a conductive metal oxide such as antimony oxide, indium oxide or tin oxide; a polymeric conductive material such as polypyrrole, polyaniline or a polymeric electrolyte; carbon fibers, carbon black or graphite powder; or a conductive powder surface-coated with any of these conductive substances, into a binder resin including thermoplastic resins such as acrylic resin, polyester resin, polyamide resin, polyvinyl acetate resin, polycarbonate resin and polyvinyl butyral resin, thermosetting resins such as polyurethane resin, phenol resin and epoxy resin, and photocurable resins, and if necessary, adding any additive (s).

Between the conductive substrate and the photosensitive layer, a barrier layer may optionally be provided which is formed of polyamide, polyurethane, epoxy resin or aluminum oxide.

As the charge-generating material contained in the charge generation layer, usable are azo pigments such as Sudan Red and Diane Blue, quinone pigments such as pyrene, quinone and anthanthrone, quinocyanine pigments, perylene pigments, indigo pigments such as indigo and thioindigo, and phthalocyanine pigments, as well as other organic pigments, any of which may be used alone or in a mixture of two or more.

To the charge generation layer, a binder resin may optionally be added. As examples of the binder resin, it may include thermoplastic resins such as acrylic resin, polyester resin, polyamide resin, polyvinyl acetate resin, polycarbonate resin and polyvinyl butyral resin, thermosetting resins such as polyurethane resin, phenol resin and epoxy resin, and photocurable resins. When the charge generation layer is formed, the above charge-generating material and the binder resin may be dispersed in a suitable solvent, and the dispersion obtained may be applied to the conductive substrate on which any desired functional layer(s) has or have been formed. To the charge generation layer, any necessary additive(s) may further be added.

To form the charge transport layer, usually a solvent is added to a charge-transporting material and a binder resin to prepare a coating fluid, and this may be applied by a coating means to the conductive substrate on which the charge generation layer has been formed, thus the photosensitive layer is formed. Materials for the charge transport layer may include hydrazone compounds, stilbene compounds, pyrazoline compounds, oxazole compounds, thiazole compounds and triarylamine compounds.

As the solvent used here, a solvent capable of well dissolving the binder resin and the charge-transporting material may be selected. As especially desirable examples, it may include ketones such as methyl ethyl ketone, acetone, methyl isobutyl ketone and cyclohexanone; ethers such as diethyl ether and tetrahydrofuran; esters such as ethyl acetate and butyl acetate; hydrocarbons such as toluene and benzene; and halogenated hydrocarbons such as chlorobenzene and dichloromethane.

A binder resin for the charge transport layer include, e.g., thermoplastic resins such as acrylic resin, polyester resin, polyamide resin, polyvinyl acetate resin, polycarbonate resin and polyvinyl butyral resin, and thermosetting resins such as polyurethane resin, phenol resin and epoxy resin. The above charge-transporting material and any of these resins may be dispersed in a suitable solvent, and the dispersion obtained may be applied to the charge generation layer. To the charge transport layer, any necessary additive (s) may further be added.

The proportion of the charge-transporting material to the binder resin depends on the types of the binder resin and charge-transporting material, and may usually be from 20 to 70% by weight, and particularly preferably from 30 to 65% by weight. If the charge-transporting material is in a too small proportion, good sensitivity may not be obtained. If on the other hand the charge-transporting material is in a too large proportion, the charge transport layer formed as the surface layer may have a low strength and tend to be scratched.

A lubricant such as a inorganic filler, polyethylene, polyfluoroethylene or silica may optionally be added to the charge transport layer. The proportion of the lubricant to the binder resin of the charge transport layer may be from 0.1 to 50% by weight, and particularly preferably from 1 to 30% by weight. Any necessary additive(s) may further be added, as exemplified by a dispersing agent, a silicone oil, a leveling agent, a metal soap and a silane coupling agent.

As a charge transport layer preferably used in combination with the negatively chargeable toner, it may be a charge transport layer formed using as the charge-transporting material a hydrazone compound, a stilbene compound or a triarylamine compound alone or in a mixture of two or more compounds, and using as the binder resin a polycarbonate resin or a polyarylate resin.

To the charge generation layer and the charge transport layer, additives such as an electron-attracting material, an electron-donating material, an ultraviolet light absorber and an antioxidant may optionally be added.

In the present invention, a protective layer may further be provided on the charge transport layer. As materials for making up the protective layer, they may include polyester, polyarylate, polyethylene, polystyrene, polybutadiene, polycarbonate, polyamide, polypropylene, polyimide, polyamide-imide, polysulfone, polyacrylic ether, polyacetal, phenolic, acrylic, silicone, epoxy, urea, allyl, alkyd, butyral, phenoxy, phosphazene, acryl-modified epoxy, acryl-modified urethane and acryl-modified polyester resins. The protective layer may preferably have a layer thickness of from 0.2 to 10 $\mu$m.

To the protective layer, additives such as an antioxidant may further be added for the purpose of improving weatherability. In the protective layer, a conductive powder such as conductive tin oxide or conductive titanium oxide may also be dispersed for the purpose of resistance control.

As materials constituting the protective layer preferably used in combination with the negatively chargeable toner, they may include polyacrylate resins and polycarbonate resins.

In the present invention, the above respective layers may be formed using a coating method such as dip coating, spray coating, roll coater coating or gravure coating.

As described above, according to the present invention, when the electrostatic latent image formed by exposure to the laser light ON/OFF-controlled in accordance with image signals is formed into a visible image by the contact developing system in which the toner-carrying member is brought into contact with the image-bearing member at a stated pressure, the image-bearing member is so triboelectrified that its surface layer has a charge polarity which is a different polarity with respect to the charge polarity of the toner. This enables the toner to be maintained at the regular charge polarity to prevent the toner's triboelectricity from lowering, even when the toner is rubbed with the image-bearing member surface. Hence, the density gradation characteristics can be maintained in a good condition. And line-image latent images such as character images can also be formed into visible images using the toner in a proper quantity, so that the toner consumption can be prevented from increasing and at the same time the spots around line images can be prevented from occurring. Moreover, the reversal fog can also be prevented, and a lower running cost of the whole system and a longer service life of the developing unit can be achieved.

In the image-forming apparatus of the present invention, when the above toner is the negatively chargeable toner, the triboelectric series relation among the surface layer of the image-bearing member as the image-bearing member, the toner particles and the external additive may preferably be in the following order from the negative side.

(a) the external additive, the toner particles, and the surface layer of the photosensitive drum 1;
(b) the toner particles, the external additive, and the surface layer of the photosensitive drum 1; or
(c) the toner particles, the surface layer of the photosensitive drum 1, and the external additive.

In the image-forming apparatus of the present invention, when the above toner is the positively chargeable toner, the triboelectric series relation among the surface layer of the image-bearing member as the image-bearing member, the toner particles and the external additive may also preferably be in the following order from the positive side.

(d) the external additive, the toner particles, and the surface layer of the photosensitive drum 1;
(e) the toner particles, the external additive, and the surface layer of the photosensitive drum 1; or
(f) the toner particles, the surface layer of the photosensitive drum 1, and the external additive.

Controlling the triboelectric series relationship of the toner particles and the external additive with respect to the surface layer of the photosensitive drum 1 to be as shown above enables the toner to be maintained at the regular charge polarity to prevent the toner's triboelectricity from lowering, even when the toner is rubbed with the photosensitive drum surface in the contact developing system. Hence, the density gradation characteristics can be maintained in a good condition. More specifically, using the negatively chargeable toner in the image-forming apparatus of the present invention, when the relationship of either of the above (a) and (b) is established, the toner particles and the external additive can maintain the regular negatively charged characteristics through the rubbing of the toner with the photosensitive drum surface. Also, when the relationship of the above (c) is established, through the rubbing of the toner with the photosensitive drum surface the toner particles can stably maintain the negatively charged characteristics and at the same time the external additive is positively charged. The external additive thus positively charged acts as if it is what is called the carrier in two-component development systems, whereby the toner particles can be negatively charged more effectively.

Meanwhile, using the positively chargeable toner in the image-forming apparatus of the present invention, when the relationship of either of the above (d) and (e) is established, the toner particles and the external additive can maintain the regular positively charged characteristics through the rubbing of the toner with the photosensitive drum surface. Also, when the relationship of the above (f) is established, through the rubbing of the toner with the photosensitive drum surface the toner particles can stably maintain the positively charged characteristics and at the same time the external additive is negatively charged. The external additive thus negatively charged acts as if it is what is called the carrier in two-component development systems, whereby the toner particles can be positively charged more effectively.

Controlling the triboelectric series relationship of the toner particles and the external additive with respect to the surface layer of the photosensitive drum 1 to be any of the above (a) to (f) enables the toner to be provided with a proper quantity of triboelectricity. Hence, the toner can be prevented from moving in excess to line-image latent images, so that the toner consumption can be prevented from increasing and at the same time the spots around line images can be prevented from occurring.

The image-forming apparatus of the present invention can be realized by appropriately selecting the surface layer of the photosensitive drum, the toner particles and the external additive and using these in combination so that the relationship of any of the above (a) to (f) can be established.

As conditions for the development high voltage applied when the electrostatic latent image formed under either of the above (a) and (d) is developed, the contrast potential |Vl−Vdc| (Vcont) which corresponds to the potential difference between the development high voltage (Vdc) and the image area potential (Vl) at which the maximum toner image density is to be obtained may preferably be within the range of from 50 to 400 V, and the back contrast potential |Vd−Vdc| (Vback) which corresponds to the potential difference between the development high voltage (Vdc) and the nonimage area potential (Vd) may preferably be within the range of from 50 to 500 V.

As conditions for the development high voltage applied when the electrostatic latent image formed under either of the above (a) and (d) is developed, the contrast potential |Vl−Vdc| (Vcont) which corresponds to the potential difference between the development high voltage (Vdc) and the image area potential (Vl) at which the maximum toner image density is to be obtained may preferably be within the range of from 50 to 400 V, and the back contrast potential |Vd−Vdc| (Vback) which corresponds to the potential difference between the development high voltage (Vdc) and the nonimage area potential (Vd) may preferably be within the range of from 50 to 500 V.

As conditions for the development high voltage applied when the electrostatic latent image formed under either of the above (c) and (f) is developed, the contrast potential |Vl−Vdc| (Vcont) which corresponds to the potential difference between the development high voltage (Vdc) and the image area potential (Vl) at which the maximum toner image density is to be obtained may preferably be within the range of from 50 to 400 V, and the back contrast potential |Vd−Vdc| (Vback) which corresponds to the potential difference between the development high voltage (Vdc) and the non-image area potential (Vd) may preferably be within the range of from 100 to 400 V.

Second Embodiment

The image-forming apparatus according to the second embodiment of the present invention is a multi-color image-forming apparatus having:

an image-bearing member for holding thereon an electrostatic latent image;

a charging means for charging the surface of the image-bearing member electrostatically;

an exposure unit for forming the electrostatic latent image on the image-bearing member by exposing the image-bearing member having been charged by the charging means, to light having been modulated in accordance with image signals; and a plurality of developing units for developing electrostatic latent images with toners having different colors. The developing units each have at least a toner-carrying member for carrying and transporting thereon a toner having different color; the toner-carrying member of one developing unit selected from the developing units is alternately brought into contact with the image-bearing member to form a developing zone, and in the developing zone the toner is made to adhere electrically to the electrostatic latent image formed on the image-bearing member, to render the electrostatic latent image visible; and these steps are sequentially repeated for each of the remaining developing units to form toner images.

Figure 3:
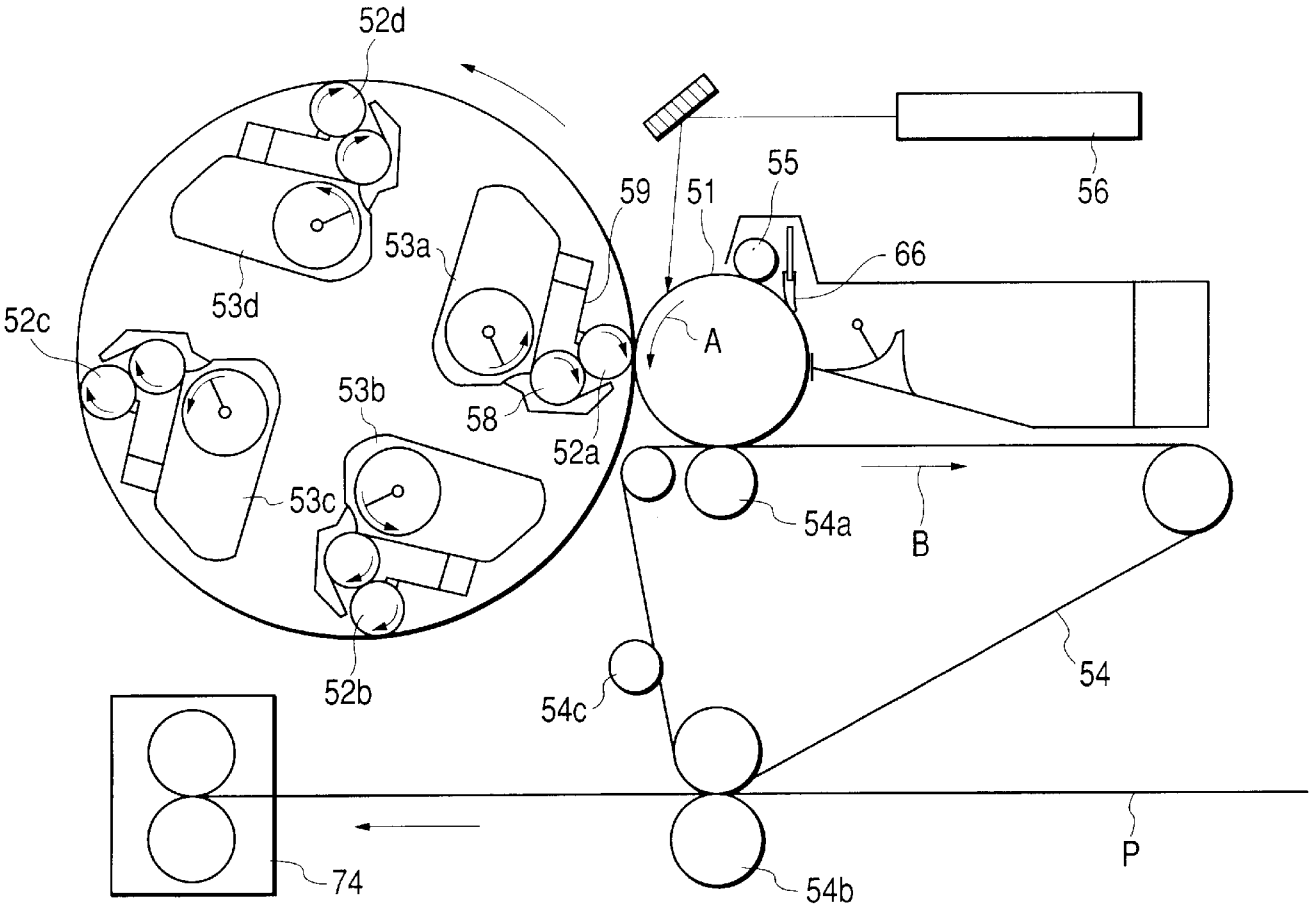
FIG. 3 is a schematic illustration of the construction of another example of the image-forming apparatus of the present invention.
Figure 4:
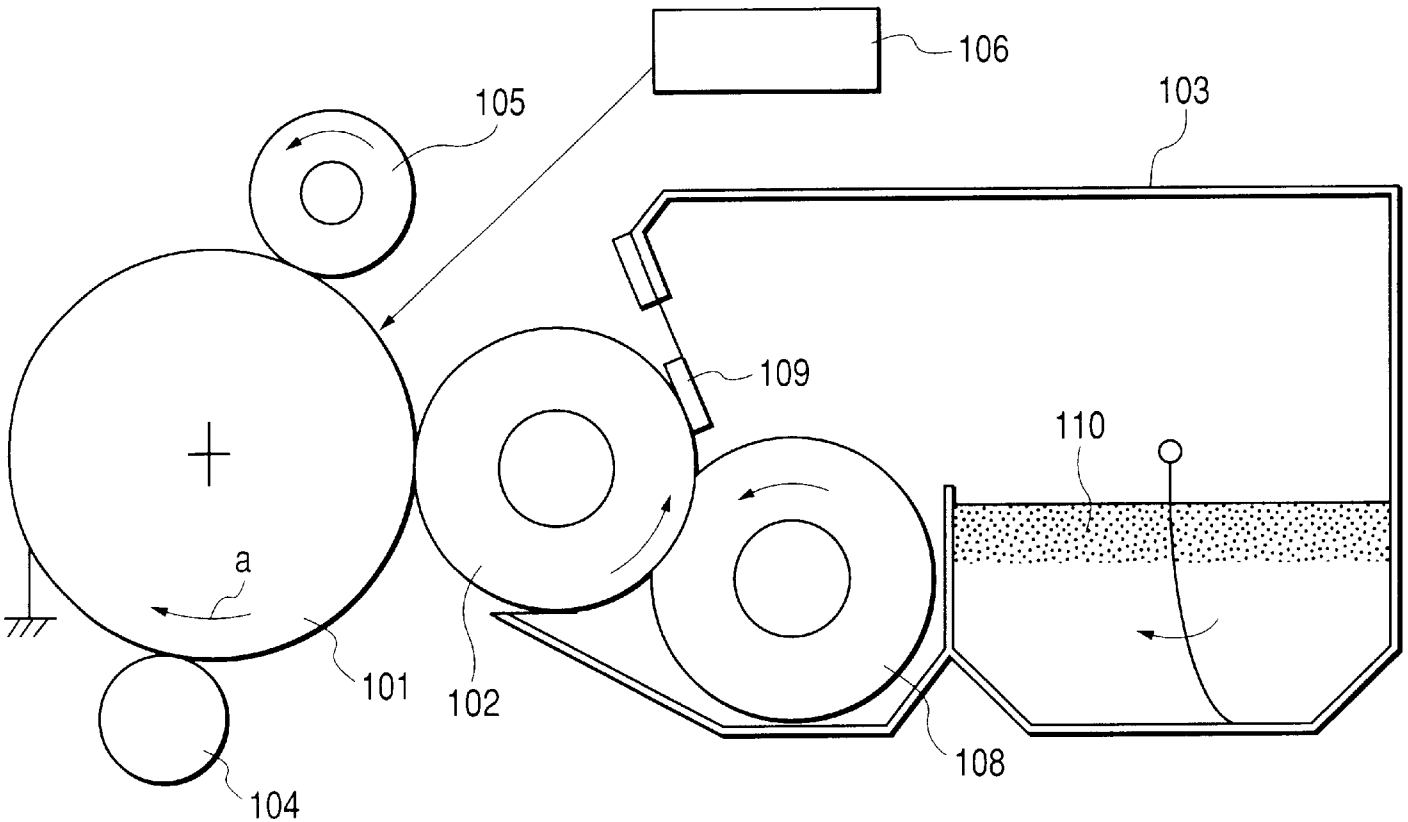
FIG. 4 is a schematic illustration of the construction of an example of a conventional image-forming apparatus.
Figure 5:
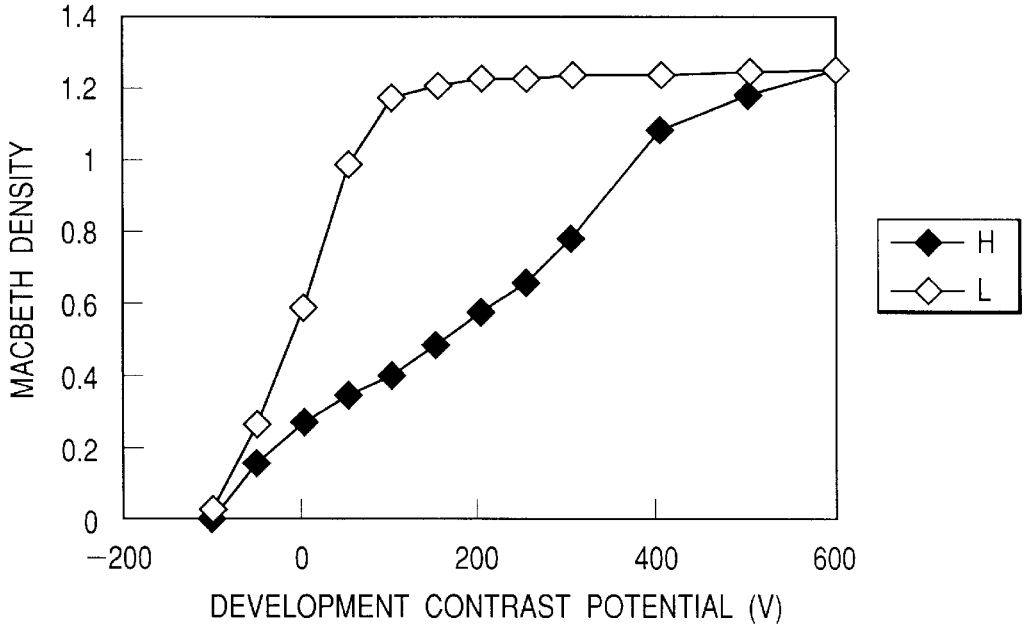
FIG. 5 is a graph showing density gradation characteristics with respect of analogue latent images.
Figure 6:
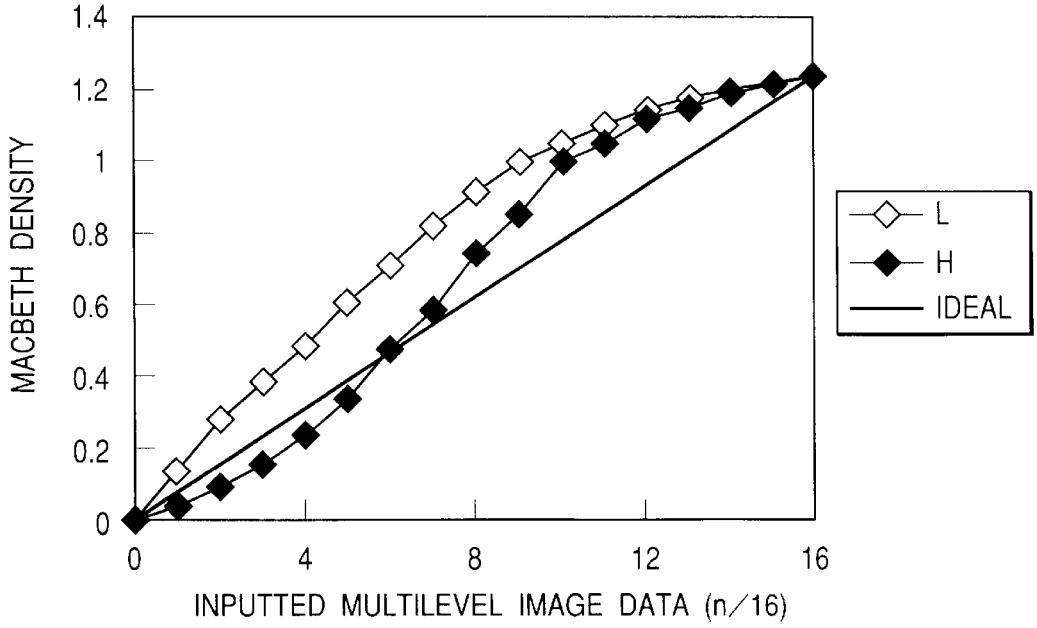
FIG. 6 is a graph showing density gradation characteristics with respect of digital latent images.

FIG. 3 is a schematic cross-sectional view showing the construction of an example of the multicolor image-forming apparatus according to the present second embodiment. This multicolor image-forming apparatus is an apparatus in which multicolor toner images formed on a first image-bearing member photosensitive drum are superimposed and held on a second image-bearing member intermediate transfer belt, which are then transferred collectively to a transfer medium. The construction of this apparatus is described below with reference to FIG. 3.

A first image-bearing member photosensitive drum 51 is rotatively driven by a drive means (not shown) in the direction of an arrow A shown in the drawing, and is uniformly electrostatically charged by means of a primary charging assembly 55. When the negatively chargeable toner is used, the photosensitive drum 51 may preferably have a surface potential, as nonimage area potential (Vd), within the range of from −500 to −800 V. When the positively chargeable toner is used, the drum may preferably have a surface potential, as non-image area potential (Vd), within the range of from +500 to +800 V.

The photosensitive drum 51 is exposed by means of an exposure unit 56 to laser light modulated in accordance with image signals of black-color component signals, whereupon a latent image is formed on the photosensitive drum 51. When the negatively chargeable toner is used, the image area potential (Vl) at which the maximum toner image density is to be obtained on the photosensitive drum surface may preferably be within the range of from −50 to −200 V. When the positively chargeable toner is used, it may preferably be within the range of from +50 to +200 V.

With further rotation of the photosensitive drum 51 in the direction of an arrow A, among developing units 53*a*, 53*b*, 53*c* and 53*d* supported by a rotary support, the developing unit 53*a* holding therein a black toner is so rotated as to face the photosensitive drum 51, and a developing roller 52*a* of the developing unit 53*a* selected comes into contact with the photosensitive drum 51 and transports the toner onto the photosensitive drum 51, whereupon the latent image is developed. A development high voltage which is a development bias voltage of direct-current voltage is applied to the developing roller 52, where the contrast potential |Vl−Vdc| (Vcont) corresponding to the potential difference between the development high voltage (Vdc) and the image area potential (Vl) at which the maximum toner image density is to be obtained may preferably be within the range of from 50 to 400 V.

A second image-bearing member intermediate transfer belt 54 is rotated in the direction of an arrow B at a speed substantially equal to that of the photosensitive drum 51, where the toner image formed and held on the photosensitive drum 51 is primarily transferred to the periphery of the intermediate transfer belt 54 by the aid of a primary transfer bias applied to a primary transfer roller 54*a*. When the negatively chargeable toner is used, the primary transfer bias applied to the primary transfer roller 54*a* may preferably be within the range of from +50 to +2,000 V. When the positively chargeable toner is used, it may preferably be within the range of from −50 to −2,000 V.

The above processing is sequentially performed for each of the respective colors, i.e., black color (K), magenta color (M), cyan color (C) and yellow color (Y). Thus, toner images corresponding to these colors are formed on the intermediate transfer belt 54.

Next, a transfer medium P is transported at a preset timing. Simultaneously, a secondary transfer bias is applied to a secondary transfer roller 54*b*, and the toner images are transferred collectively from the intermediate transfer belt 54 to the transfer medium P. When the toners used are negatively chargeable toners, the secondary transfer bias applied to the secondary transfer roller 54*b* may preferably be within the range of from +50 to +5,000 V. When the toners are positively chargeable toners, it may preferably be within the range of from −50 to −5,000 V.

The transfer medium P is further transported to a fixing unit 74, where the toner images held on the transfer medium P are heat and pressure fixed, so that a multi-color image is obtained. Also, the transfer residual toner on the intermediate transfer belt 54 is removed by cleaning with an intermediate transfer belt cleaner 54*c*. Meanwhile, the transfer residual toner on the photosensitive drum 51 is removed by cleaning with a cleaning unit 66 having a known cleaning means (blade).

The image-forming apparatus described above can form multicolor images. Its constituent members are basically the same as those of the image-forming apparatus according to the first embodiment except for using the rotatable rotary support supporting a plurality of developing units and the second image-bearing member intermediate transfer belt 54. Accordingly, the description on them is not repeated.

The above multi-color image-forming apparatus is so constructed that it has a single first image-bearing member photosensitive drum with respect to a plurality of developing units. Hence, in order to maintain the density gradation characteristics and prevent the spots around line images in a good and stable state, m the triboelectric series relationship of the surface layer of the photosensitive drum with respect to the toners, the former must have a charge polarity which is a different polarity with respect to all color toners. If on one of the color toners this relationship can not be satisfied, not only the density gradation characteristics may deviate or the spots around line images may occur with respect to that color, but also such a toner may influence other colors. Because of the multicolor, image-forming apparatus, when color-superimposed images are formed and the color on which the density gradation characteristics have deviated is superimposed on some color on which good density gradation characteristics have been obtained, the resultant superimposed images may differ from the desired superimposed color images. The same may also apply to the spots around line images with respect to superimposed images.

In the cleaning unit 66, too, a single cleaning unit must deal with a plurality of color toners, and the capacity of the cleaning unit must be adjusted to the volume of waste toners.

Making its capacity larger, however, brings about such problems that the image-forming apparatus must be made large in size and a cost increase may result, and hence the capacity is required to be adjusted to the minimum toner volume. However, where any fog caused by the occurrence of reversal toner has increased, this fog is not transferred onto the intermediate transfer belt 54, so that all the fog toner is collected in the cleaning unit 66. As a result, the quantity of waste toners is beyond the capacity of the cleaning unit to cause toner leakage before the lifetime of the cleaning unit is completed, and also cause contamination of the image-forming apparatus main body with toners.

Now, the present invention is characterized in that, in the triboelectric series relationship between the respective color toners and the surface layer of the image-bearing member photosensitive drum 51, the surface layer of the photosensitive drum 51 has a charge polarity which is a different polarity with respect to the charge polarities of all the toners.

In the present invention, as in the first embodiment, the surface layer of the photosensitive drum has a triboelectric charge polarity which is a different polarity with respect to the charge polarities of all the color toners also in the multicolor, image-forming apparatus employing the contact developing system. This enables the toners of respective colors to be maintained at the regular charge polarity to prevent the toner's triboelectricity from lowering. Hence, the density gradation characteristics can be maintained in a good condition for not only a single color but also superimposed colors. Also, line-image latent images such as character images can be formed into visible images using the toners in proper quantities, so that spots around line images of superimposed color letters can also be prevented and at the same time the toner consumption can be prevented from increasing. Moreover, the reversal fog can also be prevented and also the photosensitive drum can be resistant to wear and scratching. Hence, the photosensitive drum can be improved in running performance and a lower running cost can be achieved.

In the present invention, the triboelectric charge characteristics of i) the toner or toner particles, ii) the external additive and iii) the surface layer of the image-bearing member (electrophotographic photosensitive member) are measured by the following measuring method.

Figure 7:
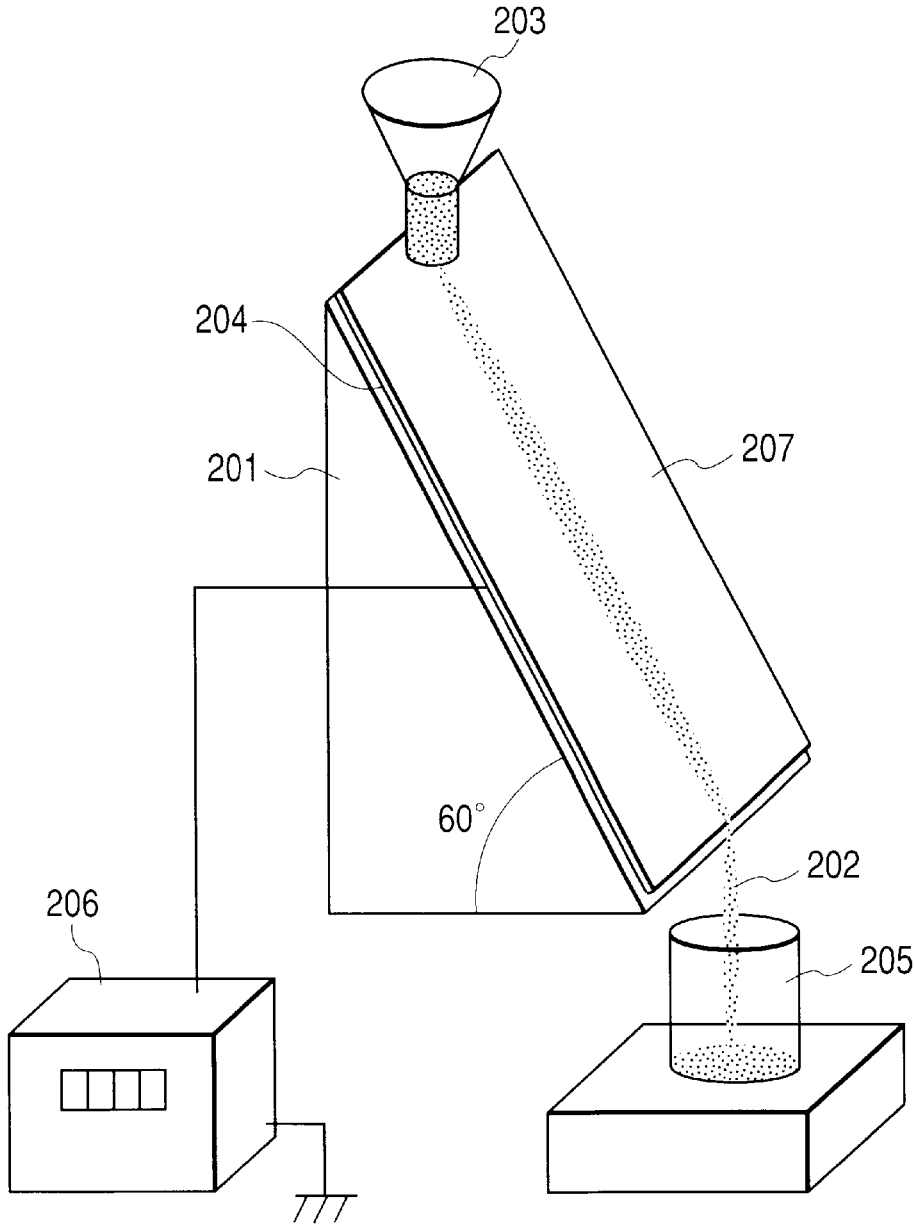
FIG. 7 is a schematic view of a device for measuring the quantity of triboelectricity.

FIG. 7 schematically illustrates a device for measuring the quantity of triboelectricity. This device is constituted of a support stand 201 inclined at 60° with respect to a horizontal plane, a contacting-powder holder 203 which holds therein a contacting powder 202 for measurement, a measuring-object support plate 204 supported on the support stand 201, a collection container 205 which collects the contacting powder 202 fed onto this measuring-object support plate 204, and an electrometer 206 (manufactured by Keithley Co.; Model 6514) connected with the measuring-object support plate 204. The contacting powder 202 is flowed from the contacting-powder holder 203 over a measuring object 207 coated on the measuring-object support plate 204, and the quantity of charge generated by friction is indicated on the electrometer 206.

To evaluate the triboelectric charge characteristics of i) the toner or toner particles, ii) the external additive and iii) the surface layer of the image-bearing member in the present invention, the charge transport layer or protective layer described above, serving as the surface layer of the image-bearing member, is formed as the measuring object 207 by dip-coating a 1 mm thick stainless steel sheet as the measuring-object support plate 204 with its coating fluid, followed by drying. Then, the negatively chargeable toner particles or the negatively chargeable toner and the positively chargeable toner particles or the positively chargeable toner which are made from the binder resin, colorant, charge control agent, release agent and so forth described previously are produced, and these toner particles, the external additive added to the toner particles and the toners are each used as the contacting powder 202 to measure the charge characteristics of the toner particles, external additive and toner with respect to the measuring object 207. Also, the charge characteristics of the external additive with respect to the toner particles are measured using as the measuring object 207 a sample prepared by pressure molding the toner particles into a plate and using as the contacting powder 202 the external additive.

Figure 8:
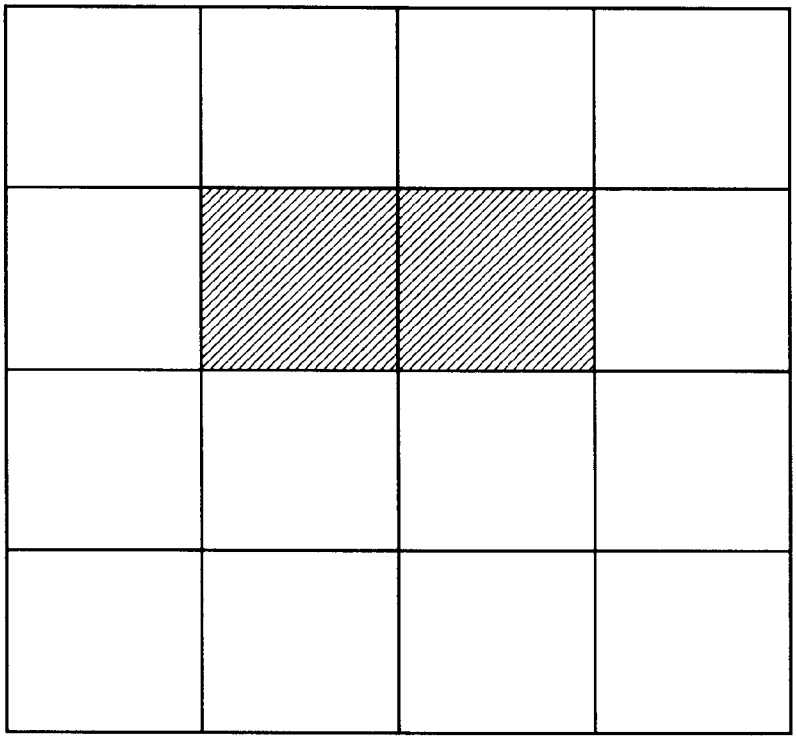
FIG. 8 is a view for illustrating the measurement of image density.
Figure 9:
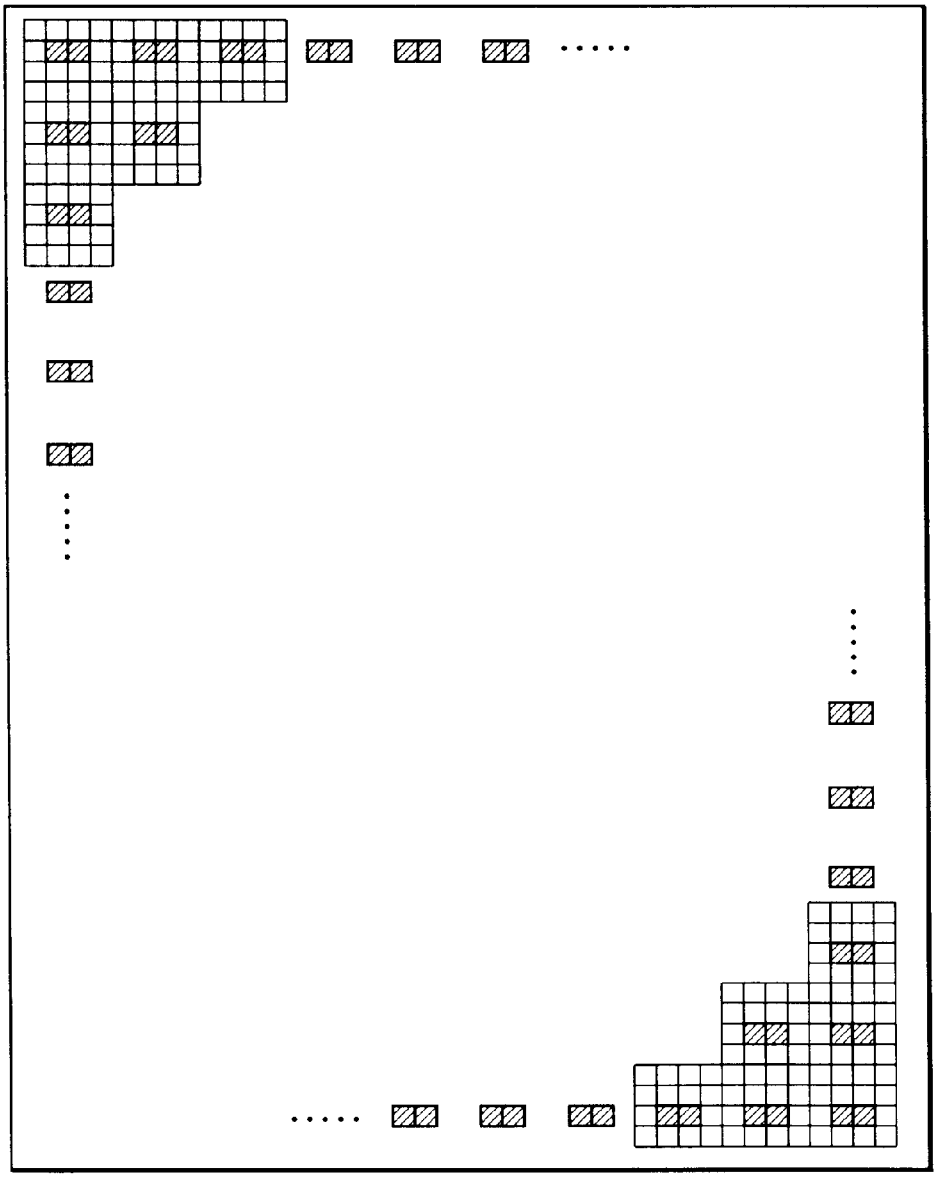
FIG. 9 is a view for illustrating the measurement of image density.
Figure 10:
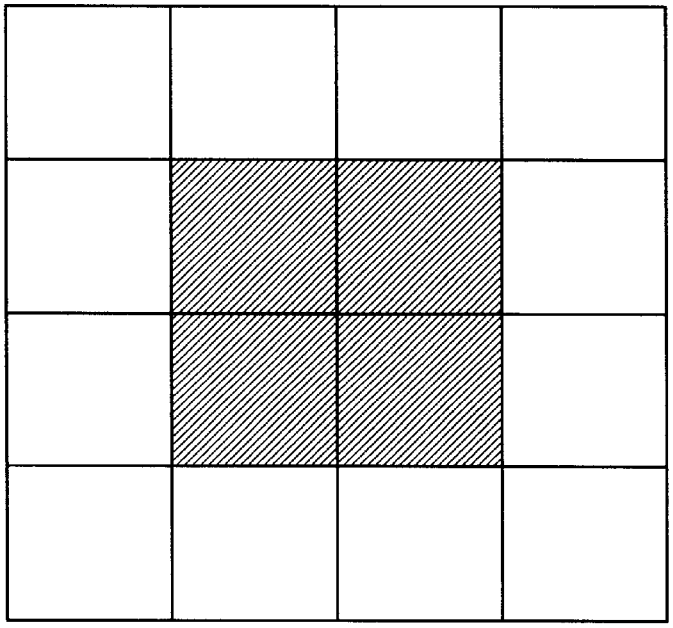
FIG. 10 is a view for illustrating the measurement of image density.

The image density referred to in the present invention is the value measured with a reflection densitometer RD918, manufactured by Macbeth Co. Stated specifically, using a repeating pattern in which two dots in a dither matrix constituted of 4 dots×4 dots as shown in FIG. 8 have been exposed, a black-color halftone pattern (FIG. 9) formed by repeating the repeating pattern over the whole region of an image formation region is reproduced, and densities at 5 spots (upper left, upper right, middle, lower left and lower right) of its image whole area are measured, and the average value of the measurements is regarded as 2/16 multi-level image (gradational image) density. Similarly, using a repeating pattern in which four dots in a dither matrix constituted of 4 dots×4 dots as shown in FIG. 10 have been exposed, the average value of densities at 5 spots of the image reproduced as a halftone pattern formed by repeating the repeating pattern is regarded as 4/16 multilevel image density.

For the yellow color, magenta color and cyan color used in the multi-color image-forming apparatus, too, the above halftone pattern image is reproduced in each single color to obtain the 2/16 multilevel image density and the 4/16 multilevel image density. The densities of yellow color, magenta color and cyan color are also measured with the reflection densitometer RD918 as in the case of the black color.

Since the fog occurring in the image-forming apparatus of the contact developing system as in the present invention is the reversal fog, it is little transferred to the intermediate transfer member. Accordingly, a method is used in which the fog on the electrophotographic photosensitive member is directly picked to make an evaluation. As a method of measuring the fog, the fog toner transferred onto the electrophotographic photosensitive member is picked up with a pressure-sensitive adhesive tape (sample tape) having a transparent base material, and this sample tape and an unused pressure-sensitive adhesive tape as a reference tape to which nothing has been made to adhere are stuck onto white paper, where their respective reflectances are measured. The reflectance of the sample tape is subtracted from the reflectance of the reference tape to determine fog density. The reflectances are measured with TC-6DS, manufactured by Tokyo Denshoku K.K.

The present invention is described below in greater detail by giving Examples. The present invention is by no means limited to these Examples.

Example 1

As an image-forming apparatus, the same one as that described above in First Embodiment was used. The image-forming apparatus used in Example 1 is described below in detail with reference to FIG. 1.

As the developing roller 2, a roller having the following construction was used. On the periphery of a mandrel comprised of a surface-plated steel rod, an EPDM layer was formed as the base layer, and an ether urethane layer whose resistance was regulated by incorporating carbon black as a conducting agent was further formed thereon as the surface layer.

The image-bearing member photosensitive drum 1 is described here. First, on an aluminum cylinder of 30 mm in diameter and 260.5 mm in length, a solution prepared by dissolving 5 parts by weight of a 6/66/610/12 terpolymer polyamide in a mixed solvent of 70 parts by weight of methanol and 25 parts by weight of butanol was applied by dipping, followed by drying to provide a subbing layer of 0.65 $\mu$m in thickness.

Next, 5 parts by weight of oxytitanium phthalocyanine crystals having strong peaks at diffraction angles 2Θ±0.2° of 9.0°, 14.2°, 23.9° and 27.1° in X-ray diffraction was added to a solution prepared by dissolving 5 parts by weight of polyvinyl butyral resin in 100 parts by weight of cyclohexanone, and were dispersed by means of a sand mill making use of glass beads of 1 mm in diameter. To the resultant dispersion, 200 parts by weight of ethyl acetate was added to dilute it, and this was applied on the subbing layer, followed by drying at 80° C. for 10 minutes to form a charge generation layer of 0.25 $\mu$m in layer thickness.

Then, 10 parts by weight of polycarbonate resin and 10 parts by weight of a triarylamine compound represented by the following structural formula (I) were dissolved in 80 parts by weight of methylene chloride, and the solution obtained was applied on the above charge generation layer by dipping, followed by drying at 110° C. for 1 hour to form a charge transport layer of 24 $\mu$m in layer thickness. Thus, a multilayer type electrophotographic photosensitive member as the image-bearing member was produced. This electrophotographic photosensitive member is designated as photosensitive drum A.

(I)

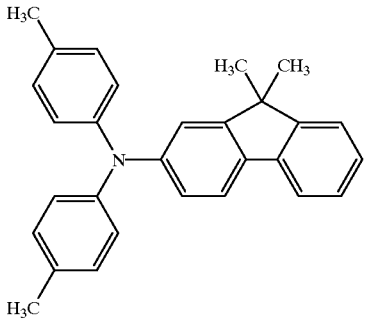

A negatively chargeable toner 10 used in Example 1 is described here. First, 100 parts by weight of polyester resin, 5 parts by weight of carbon black, 3 parts by weight of low-molecular-weight polyethylene and 2 parts by weight of a monoazo metal complex (negative charge control agent) represented by the following Formula (II) were mixed using a Henschel mixer, and the mixture obtained was melt-kneaded by means of a twin-screw extruder. The resultant kneaded product was crushed by means of a hammer mill, and then the crushed product obtained was pulverized by means of a jet mill, further followed by air classification to obtain toner particles (classified product) with an average particle diameter of 7.5 $\mu$m.

To 100 parts by weight of the toner particles thus obtained, 1 part by weight of hydrophobic fine silica powder obtained by surface-treating 100 parts by weight of silica having a specific surface area of 200 $m^2/g$, with 15 parts by weight of isobutyltrimethoxysilane and 10 parts by weight of dimethylsilicone oil was externally added to obtain a negatively chargeable non-magnetic toner. This negatively chargeable non-magnetic toner is designated as toner (a).

(II)

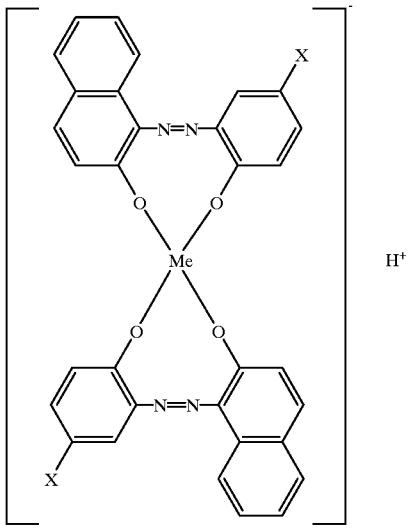

In the formula, X represents a halogen atom (e.g., chlorine), and Me a chromium (Cr) atom.

Charge characteristics of the toner (a) thus produced and the surface layer of the photosensitive drum A were examined in the following way: On the measuring-object support plate 204 of the device for measuring the quantity of triboelectricity shown in FIG. 7, the charge transport layer, the surface layer of the photosensitive drum A, was formed as the measuring object 207 by applying its coating fluid, followed by drying. Using the toner (a) as the contacting powder 202, the triboelectric charge characteristics of the surface layer of the photosensitive drum A with respect to the toner (a) were examined. As the result, the surface layer (charge transport layer) of the photosensitive drum A showed positive charge upon its friction with the toner (a), and showed positive triboelectric charge characteristics, which was opposite in polarity with respect to the charge polarity of the toner (a) provided with negative triboelectric charges by the elastic developing blade and developing roller in the developing unit to become negatively charged. Also, the triboelectric series relationship between them was in the order of the hydrophobic fine silica powder, the toner particles and the surface layer of the photosensitive drum A from the negative side.

Next, a process cartridge of Laser Jet 4050, manufactured by Hewlett Packard Co., was remodeled to have the construction shown in FIG. 1, to obtain an image-forming apparatus made able to form images by the contact developing system. Its elastic developing blade made of a rubber material was replaced with the developing blade 9 constituted of the thin metal sheet 9*a* comprised of a phosphor bronze sheet and the elastic member 9*b* comprised of a polyamide elastomer. Also, its developing sleeve holding a stationary magnet internally was replaced with the developing roller 2 having an EPDM layer as the base layer and as the surface layer an ether urethane layer whose resistance was regulated by incorporating carbon black as a conducting agent. Still also, its developing container was partially worked so that the toner feed roller 8 comprising an elastic roller provided with a urethane foam was brought into contact with the developing roller 2 and was rotatable in the same direction as the developing roller 2. The toner (a) was supplied to the developing unit 3. In addition, its photosensitive drum was replaced with the above photosensitive drum A, and a running test for evaluation was made by the contact developing system. The toner (a) on the developing roller 2 was provided with negative triboelectric charges by the aid of the developing blade 9 to become negatively charged.

In the running test for evaluation, as conditions for the setting of construction, the process speed was set at 94.2 mm/sec, the peripheral speed of the developing roller 2 was so set as to be 160.1 mm/sec and the peripheral speed of the toner feed roller 8 was set to be 120.0 mm/sec. The touch pressure of the developing blade 9 was so set as to be 25 g/cm in linear pressure. Under such conditions for the setting, the toner (a) held on the developing roller 2 was in a quantity of triboelectricity of −20 to −40 $\mu$C/g. Electric potential was so set that the photosensitive drum had a surface potential of −700 V as nonimage area potential (Vd) and −120 V as image area potential (Vl) at which the maximum toner image density was to be obtained. Also, the development high voltage (Vdc) applied to the developing roller 2 was set to be −370 V so that the contrast potential |Vl−Vdc| (Vcont) came to 250 V.

Using the above image-forming apparatus, an image having an image area percentage of 3% was continuously printed by reversal development, and the densities of 2/16 multilevel image and 4/16 multilevel image in 16 gradation were measured at an interval of 1,000 sheets by the method described previously in Embodiments of the present invention. Character images were also printed, and whether or not any spots around line images occurred was visually evaluated.

The weight of the developing unit was also measured before and after the image formation to measure toner consumption. Still also, the fog toner having adhered to the surface of the photosensitive drum was sampled by picking it up with an adhesive tape, and the fog density was measured by the method described previously in Embodiments of the present invention. Each evaluation was made at a printing interval of 1,000 sheets, and finally the running test for evaluation was made on 5,000 sheets to obtain the results shown in Table 1. In the present Example, the ideal values of the 2/16 multilevel image density and 4/16 multilevel image density are 0.15 and 0.30, respectively.

Figure 11A:
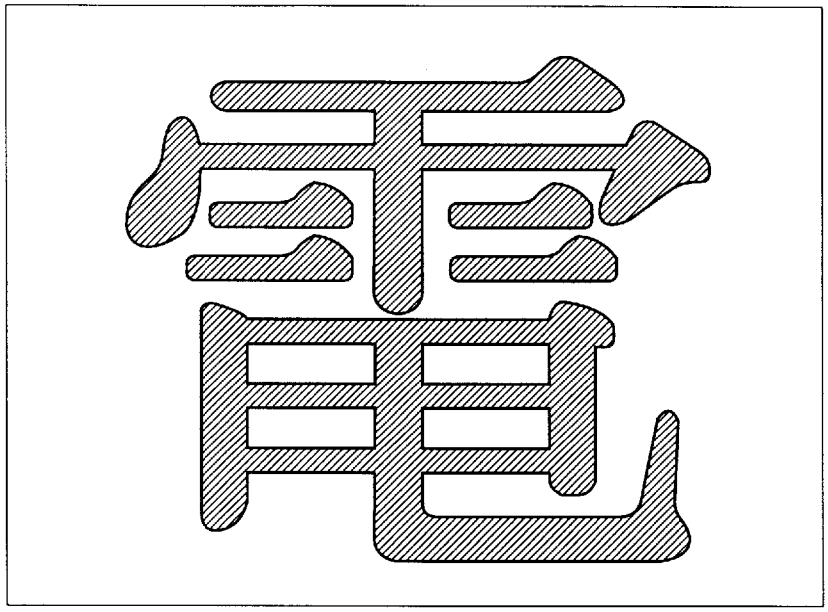
FIGS. 11A and 11B are views for illustrating how to make evaluation on toner spots around line images in Examples.
Figure 11B:
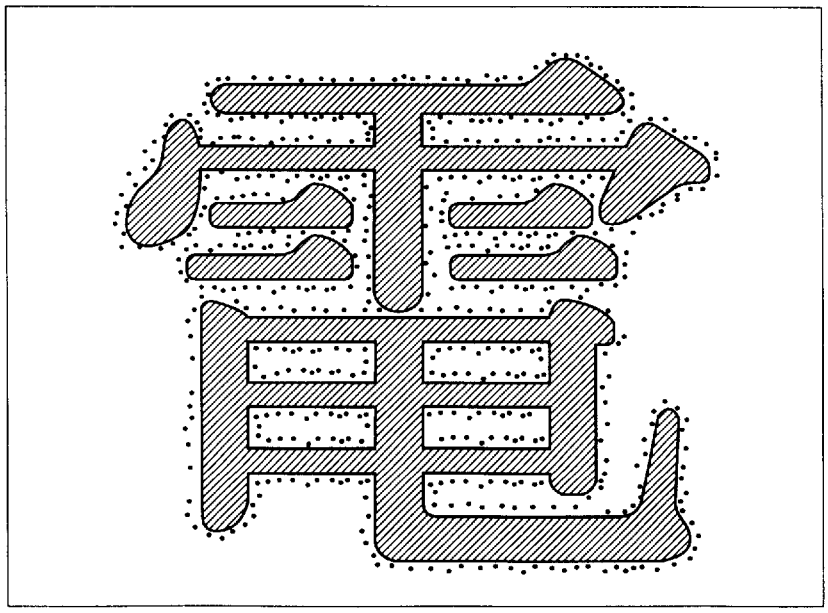

A character pattern shown in FIG. 11A was printed on plain paper, where visual evaluation was made on any toner spots around line images (a condition shown in FIG. 11B). Respective letter symbols in Table 1 in respect of the evaluation on spots around line images of character images indicate the following evaluation ranks.

A: Spots around line images seldom occur.

B: Slight spots around line images are seen.

C: Conspicuous spots around line images are seen.

As shown in Table 1, though the multi-level image densities were a little lower than the ideal densities, the photosensitive drum A of Example 1 maintained stable densities. At the same time, any spots around line images were not seen on character images throughout the running test for evaluation. Also, the fog was kept at a low density up to 5,000 sheets, and did not have any great influence on the toner consumption to cause no problems at all.

According to Example 1, when the electrostatic latent image formed by exposure to the laser light ON/OFF-controlled in accordance with image signals is formed into a visible image by the contact developing system in which the developing roller is brought into contact with the photosensitive drum at a stated pressure, the photosensitive drum is so triboelectrified that its surface layer charge transport layer has a charge polarity which is positive with respect to the charge polarity (negative) of the negatively chargeable toner. This enables the toner to be maintained to the regular negative charge polarity to prevent the toner's quantity of triboelectricity from lowering, even when the toner is rubbed with the photosensitive drum surface. Hence, the density gradation characteristics can be maintained in a good condition. Line-image latent images such as character images can also be formed into visible images using the toner in a proper quantity, so that the toner consumption can be prevented from increasing and at the same time the spots around line images can be prevented from occurring. Moreover, the reversal fog can also be prevented, and a lower running cost of the whole system and a longer service life of the developing unit can be achieved.

In Example 1, a laser scanner is used as the exposure unit. Without limitation to it, an exposure unit such as an LED (light-emitting diode) print head system or a liquid-crystal shutter array system may also be used.

The photosensitive drum and toner used in Example 1 are also not limited to those made up in Example 1. Any charge transport layer having triboelectric charge polarity which is reverse to the polarity of the toner used may of course be used under appropriate selection.

The toner in Example 1 is produced by a kneading and pulverization process. Besides, without limitation thereto, the toner may also be produced by a process in which the constituent materials are dispersed in a solution of the binder resin, followed by spray drying to obtain a toner; or a process for producing a toner by polymerization in which stated materials are mixed in monomers which are to constitute the binder resin to form an emulsion suspension, followed by polymerization to obtain the toner.

In Example 1, a negatively chargeable toner is used as the toner and materials showing positive triboelectric charge characteristics with respect to the negatively chargeable toner are used to form the charge transport layer. When, however, a positively chargeable toner is used as the toner, materials showing negative triboelectric charge characteristics with respect to the positively chargeable toner may be used to form the charge transport layer of the photosensitive drum, whereby the toner's quantity of triboelectricity can be kept from lowering according to the like principle described above, and the effect stated above can be obtained.

Comparative Example 1

In Comparative Example 1, a charge transport layer serving as the surface layer of the photosensitive drum was produced according to the following formulation.

10 parts by weight of polycarbonate resin and 10 parts by weight of a triarylamine compound represented by the above structural Formula (I) were dissolved in 40 parts by weight of monochlorobenzene and 20 parts by weight of dichloromethane to obtain a charge transport layer intermediate coating solution. Next, 15 parts by weight of a dispersion prepared by dispersing 120 parts by weight of monochlorobenzene, 30 parts by weight of polytetrafluoroethylene particles and 1.8 parts by weight of a comb-type fluorine graft polymer by means of a ball mill was added to the charge transport layer intermediate coating solution to make up a charge transport layer coating fluid.

On the measuring-object support plate 204 of the device for measuring the quantity of triboelectricity shown in FIG.

7, a charge transport layer coating fluid was applied as the measuring object 207, followed by drying. Using the toner (a) as the contacting powder 202, the triboelectric charge characteristics of the charge transport layer in this Comparative Example with respect to the toner (a) were examined. As the result, the charge transport layer used in the present Comparative Example 1 showed negative charge upon its friction with the toner (a), and showed negative charge characteristics with respect to the charge polarity of the toner (a), a negatively chargeable toner.

The charge transport layer coating fluid was applied by dipping, on the cylinder in Example 1 on which the subbing layer and the charge generation layer had been superposed, followed by drying at 110° C. for 1 hour to form a 24 $\mu$m thick charge transport layer. Thus, a multilayer type electrophotographic photosensitive member was produced. This electrophotographic photosensitive member is designated as photosensitive drum B.

This photosensitive drum B and the toner (a) was applied in the image-forming apparatus used in Example 1, and a running test for evaluation was made in the same manner as in Example 1. Results obtained are shown in Table 1.

As shown in Table 1, in Comparative Example 1, the densities of 2/16 multilevel image and 4/16 multilevel image increased with progress of the running for evaluation, until the multilevel image densities became much higher than the ideal densities when printed on 5,000 sheets. Also, the spots around line images of character images came to greatly occur with progress of the running for evaluation. Also, the fog density became higher by three to four times that in the case of Example 1, and, as an influence thereof, the toner consumption became higher, until the toner was consumed in excess in a quantity corresponding to that for 1,000 sheets or more when printed on 5,000 sheets, compared with that in Example 1.

Example 2

In the contact developing system, since the photosensitive drum and the developing roller are rotated in contact with each other, the photosensitive drum surface may greatly be worn or scratched, compared with those in the non-contact developing system.

In the present Example, a photosensitive drum was used in which a protective layer was superposed on the charge transport layer so that the photosensitive drum was durable to wear and scratches occurring on the surface upon friction. As the toner, the toner (a) used in Example 1, having negatively chargeable properties, was used.

The protective layer serving as the surface layer of the photosensitive drum in the present Example was produced according to the following formulation.

100 parts by weight of antimony-containing fine tin oxide particles having an average particle diameter of 0.02 $\mu$m, 100 parts by weight of a curable acrylic monomer, 0.1 part by weight of 2-methylthioxanthone as a photopolymerization initiator and 300 parts by weight of toluene were dispersed for 96 hours by means of a sand mill to prepare a liquid preparation for protective layer.

Next, the triboelectric charge characteristics of the protective layer in the present Example with respect to the toner (a) were examined. On the measuring-object support plate 204 of the device for measuring the quantity of triboelectricity shown in FIG. 7, the liquid preparation for the protective layer, the surface layer of the photosensitive drum in the present Example, was applied as the measuring object 207, followed by drying. Using the toner (a) as the contacting powder 202, the triboelectric charge characteristics of the protective layer with respect to the toner (a) were examined. As the result, this protective layer showed positive charge upon its friction with the toner (a), and showed positive triboelectric charge characteristics which were reverse to the charge polarity of the toner (a), a negatively chargeable toner. Also, the triboelectric series relationship between them was in the order of the hydrophobic fine silica powder, the toner particles and the surface layer of the photosensitive drum C from the negative side.

Then, the protective-layer liquid preparation was applied by spraying, on the charge transport layer of the photosensitive drum A used in Example 1, followed by drying. The coating thus formed was exposed to ultraviolet radiations by means of a high-pressure mercury lamp for 20 seconds at a light intensity of 80 mW/cm$^2$ to form a protective layer of 5 $\mu$m in layer thickness. Thus, an electrophotographic photosensitive member was produced. This electrophotographic photosensitive member is designated as photosensitive drum C.

An image-forming apparatus was used which made use of a process cartridge of Laser Jet 4050, manufactured by Hewlett Packard Co., having been remodeled to be able to form images by the contact developing system like that in Example 1 but replacing its photosensitive drum to the photosensitive drum C. The toner (a) was supplied to the developing unit 3, and an evaluation running test of 5,000 sheet printing was made in the same manner as in Example 1. Results obtained are shown in Table 2.

As shown in Table 2, though the multi-level image densities were a little lower than the ideal densities, the photosensitive drum C of Example 2 maintained stable densities. At the same time, any spots around line images were not seen on character images throughout the running test for evaluation. Also, the fog was kept at a low density up to 5,000 sheets, and did not have any great influence on the toner consumption to cause no problems at all. Moreover, any defects such as scratches were not seen on the surface of the photosensitive drum after the running test for evaluation was finished, and uniform and good image formation was performed without any difficulties at all in solid black images and images having a light gradational density.

As described the photosensitive drum is so triboelectrified that its surface layer protective layer has a triboelectric charge polarity which is reverse to the charge polarity of the toner. This enables the toner to be maintained to the regular negative charge polarity to prevent the toner's quantity of triboelectricity from lowering, even when the toner is rubbed with the photosensitive drum surface. Hence, the density gradation characteristics can be maintained in a good condition. Line-image latent images such as character images can also be formed into visible images using the toner in a proper quantity, so that the toner consumption can be prevented from increasing and at the same time the toner spots around line images can be prevented from occurring. Moreover, the reversal fog can also be prevented and also the photosensitive drum can be resistant to wear and scratching. Hence, the photosensitive drum can be improved in running performance and an image-forming apparatus having achieved a lower running cost can be provided.

Example 3

In the present Example, a multicolor image-forming apparatus was studied. Color negatively chargeable toners used in the present Example were obtained in the following way.

| | (by weight) |
|---|---|
| * Black toner particles: | |
| Polyester resin | 100 parts |
| Master batch containing 30% by weight of carbon black pigment | 20 parts |
| Di-t-butylsalicylic acid metal complex (aluminum compound) | 4 parts |
| * Magenta toner particles: | |
| Polyester resin | 100 parts |
| Master batch containing 30% by weight of quinacridone magenta pigment | 20 parts |
| Di-t-butylsalicylic acid metal complex (aluminum compound) | 4 parts |
| * Cyan toner particles: | |
| Polyester resin | 100 parts |
| Master batch containing 30% by weight of copper phthalocyanine pigment | 20 parts |
| Di-t-butylsalicylic acid metal complex (aluminum compound) | 4 parts |
| * Yellow toner particles: | |
| Polyester resin | 100 parts |
| Master batch containing 30% by weight of disazo yellow pigment | 20 parts |
| Di-t-butylsalicylic acid metal complex (aluminum compound) | 4 parts |

The above materials for each toner were mixed using a Henschel mixer, and the mixture obtained was melt-kneaded by means of a three-roll kneader. Thereafter, the kneaded product obtained was crushed by means of a hammer mill, and the crushed product obtained was further pulverized by means of a jet mill. The respective pulverized products thus obtained were air-classified to obtain black toner particles, magenta toner particles, cyan toner particles and yellow toner particles all having an average particle diameter of 8.5 $\mu$m.

To 100 parts by weight of the respective toner particles thus obtained, 1.3 parts by weight of hydrophobic fine titanium oxide powder obtained by surface-treating 100 parts by weight of titanium oxide having a specific surface area of 110 $m^2/g$, with 17 parts by weight of isobutyltrimethoxysilane was externally added to obtain non-magnetic toners (one-component developers) of black, magenta, cyan and yellow four colors.

As a photosensitive drum 51 (FIG. 3) used in Example 3, the photosensitive drum C used in Example 2 was used, having the protective layer as the surface layer. This was because in Example 3 the developing units 53 for the respective colors, supported in the rotary support, were so constructed as to repeatedly come into contact with the photosensitive drum 51 and hence the photosensitive drum had a higher possibility of being damaged than any monochromatic image-forming apparatus having a developing unit set stationarily.

The triboelectric charge characteristics of the protective layer with respect to the respective color toners were examined in the following way: On the measuring-object support plate 204 of the device for measuring the quantity of triboelectricity shown in FIG. 7, the liquid preparation for the protective layer, the surface layer of the photosensitive drum C, was applied as the measuring object 207, followed by drying. Using each of the black toner, magenta toner, cyan toner and yellow toner in the present Example as the contacting powder 202, the triboelectric charge characteristics of the protective layer in the present Example with respect to the respective toners were examined. As the result, with respect to all the four color toners, this protective layer showed positive charge upon its friction with the toners, and showed positive triboelectric charge characteristics which was reverse to the charge polarity of the color toners in the present Example which were negatively chargeable toners. Also, in each color toner, the triboelectric series relationship was in the order of the toner particles, the hydrophobic fine titanium oxide powder, and the surface layer of the photosensitive drum C from the negative side.

The above four color toners and the photosensitive drum C were used in the image-forming apparatus according to the second embodiment, shown in FIG. 3, and image formation was evaluated in the following way. In the evaluation, a process cartridge of Laser Jet 4500, manufactured by Hewlett Packard Co., was partially so remodeled as to be able to form images by the contact developing system. More specifically, its developing sleeve was replaced with a developing roller 52 having an EPDM layer as the base layer and as the surface layer an ether urethane layer whose resistance was regulated by incorporating carbon black as a conducting agent. Then, the black toner, the magenta toner, the cyan toner and the yellow toner were supplied to the developing unit 53*a,* the developing unit 53*b,* the developing unit 53*c,* the developing unit 53*d,* respectively. In addition, its photosensitive drum was replaced with the above photosensitive drum C, and an evaluation running test of 5,000 sheet printing was made in the same manner as in Example 1.

In the running test for evaluation, as conditions for the setting of construction, the process speed was set at 117.4 mm/sec, the peripheral speed of each developing roller 52 was so set as to be 205.4 mm/sec and the peripheral speed of the toner feed roller was set to be 163.0 mm/sec. The touch pressure of each developing blade 59 was so set as to be 25 g/cm in linear pressure. Under such conditions for the setting, each color toner held on the developing rollers 52*a* to 52*d* was in a quantity of triboelectricity of −20 to −40 $\mu$C/g. Electric potential was so set that the photosensitive drum had a surface potential of −700 V as nonimage area potential (Vd) and −130 V as image area potential (Vl) at which the maximum toner image density was to be obtained. Also, the development high voltage (Vdc) applied to the developing roller 52 was set to be −380 V so that the contrast potential |Vl−Vdc| (Vcont) came to 250 V.

As a result, the color toners in Example 3 were able to maintain stable densities of multilevel images in respect of all the four colors. Also, no changes in tints were seen in respect of multilevel images of red color, green color and blue color formed by superimposing two colors, showing good results. Any spots around line images were also not seen on character images throughout the running test for evaluation. Also, in respect of color characters formed by secondary colors, the spots around line images less occurred. Still also, the fog was kept at a low density up to 5,000 sheets in respect of all the four colors, and did not have any great influence on the toner consumption to cause no problems at all. Moreover, any defects such as scratches were not seen on the surface of the photosensitive drum after the running test for evaluation was finished, and uniform and good image formation was performed without any difficulties at all in solid black images and images having a light gradational density.

As described above, in the case when the contact developing system is applied in the multi-color image-forming apparatus, too, the photosensitive drum is so triboelectrified that its surface layer protective layer has a triboelectric charge polarity which is reverse to the charge polarities of the toners used. Thus, the density gradation characteristics can be maintained in a good condition in respect of not only single-color density gradation but also superimposed-color density gradation. Line-image latent images such as character images can also be formed into visible images using the toners in proper quantities, so that the toner spots around line images can be prevented also in respect of toner-superimposed color characters and at the same time the toner consumption can be prevented from increasing. Moreover, the reversal fog can also be prevented and also the photosensitive drum can be resistant to wear and scratching. Hence, the photosensitive drum can be improved in running performance and an image-forming apparatus having achieved a lower running cost can be provided.

The present Example 3 is described in the form that the image-forming apparatus has the protective layer as the photosensitive drum surface layer, and may also applicable to a case in which a charge transport layer is formed as the surface layer.

Example 3 is also described as a system in which the toner images are superimposed on the intermediate transfer belt 54 and then one time transferred to the transfer medium. The like effect is obtainable also when the toner images are directly sequentially superimposed on the transfer medium.

As multicolor, image-forming methods, a multicolor, image-forming method of what is called a tandem system is available in which a plurality of image-forming process units each internally provided with a photosensitive drum as the first image-bearing member. In this case, the construction described in Example 1 or in Example 2 is preferred.

Example 4

In Example 4, the same image-forming apparatus as the image-forming apparatus used in Example 1 was used. As the photosensitive drum, a photosensitive drum A produced in the same manner as in Example 1 was used.

A negatively chargeable toner 10 used in Example 4 is described here. First, 100 parts by weight of polyester resin, 5 parts by weight of carbon black, 3 parts by weight of low-molecular-weight polyethylene and 2 parts by weight of a monoazo metal complex represented by the following Formula (II) were mixed using a Henschel mixer, and the mixture obtained was melt-kneaded by means of a twin-screw extruder. The resultant kneaded product was crushed by means of a hammer mill, and then the crushed product obtained was pulverized by means of a jet mill, further followed by air classification to obtain negatively chargeable toner particles with an average particle diameter of 7.5 $\mu$m. This is designated as toner particles A.

To 100 parts by weight of the toner particles A thus obtained, 1 part by weight of hydrophobic fine silica powder (hereinafter "external additive A") obtained by surface-treating 100 parts by weight of silica having a specific surface area of 300 $m^2/g$, with 10 parts by weight of hexamethyldisilazane and 17 parts by weight of dimethyl-silicone oil was externally added to obtain a negatively chargeable toner. This negatively chargeable toner is designated as toner A.

(II)

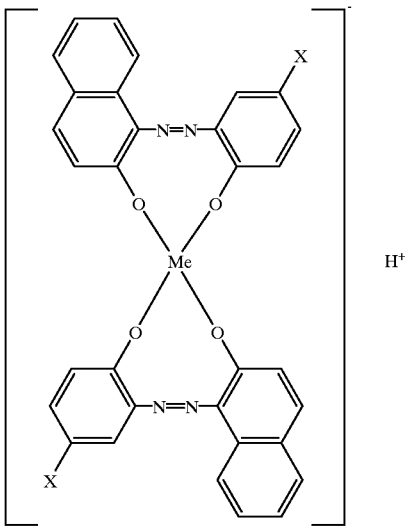

In the formula, X represents a halogen atom (e.g., chlorine), and Me a chromium (Cr) atom.

Charge characteristics of the toner particles A and external additive A which constitute the toner A thus produced with respect to the photosensitive drum A were examined in the following way: On the measuring-object support plate 204 of the device for measuring the quantity of triboelectricity shown in FIG. 7, the charge transport layer, the surface layer of the photosensitive drum A, was formed as the measuring object 207 by applying its coating fluid, followed by drying. Using the toner particles A and external additive A each as the contacting powder 202, the triboelectric charge characteristics of the toner particles A or external additive A with respect to the surface layer of the photosensitive drum A were examined.

Where the triboelectric charge characteristics of the toner particles A and external additive A with respect to the surface layer of the photosensitive drum A are measured by the use of a photosensitive drum, the triboelectric charge characteristics are examined by bringing the surface of the photosensitive drum and the toner particles A or external additive A into friction, and measuring the triboelectric charge characteristics of the toner particles A or external additive A.

The relationship of charge characteristics between the toner particles A and the external additive A was examined in the following way: The measuring-object support plate 204 (FIG. 7) was put in a flat-plate press molder and the molder was filled with the toner particles A spread over the plate in an original powdery form. This powder was pressed to obtain toner particles A molded into a plate on the measuring-object support plate 204, and this was used as the measuring object 207. The external additive A was used as the contacting powder 202 and flowed over the measuring object 207 obtained by press-molding the toner particles A, to examine the triboelectric charge characteristics of the external additive A with respect to the toner particles A.

As the result, the charge transport layer of the photosensitive drum A showed positive charge upon its friction with the toner particles A and external additive A. Also, the external additive A used in the toner A showed negative charge with respect to the toner particles A. The triboelectric series relationship between them was in the order of the external additive A, the toner particles A and the surface layer of the photosensitive drum A from the negative side.

Also, the surface layer of the photosensitive drum A was in the positive charge polarity with respect to the toner A having the negative charge polarity.

Next, like Example 1, a process cartridge of Laser Jet 4050, manufactured by Hewlett Packard Co., was remodeled to have the construction shown in FIG. 1, to obtain an image-forming apparatus made able to form images by the contact developing system. Its elastic developing blade made of a rubber material was replaced with the developing blade 9 constituted of the thin metal sheet 9*a* comprised of a phosphor bronze sheet and the elastic member 9*b* comprised of a polyamide elastomer. Also, its developing sleeve holding a stationary magnet internally was replaced with the developing roller 2 having an EPDM layer as the base layer and as the surface layer an ether urethane layer whose resistance was regulated by incorporating carbon black as a conducting agent. Still also, its developing container was partially worked so that the toner feed roller 8 comprising an elastic roller provided with a urethane foam was brought into contact with the developing roller 2 and was rotatable in the same direction as the developing roller 2. To this developing unit 3, 120 g of the toner A was supplied. In addition, its photosensitive drum was replaced with the above photosensitive drum A, and a running test for evaluation was made by the contact developing system.

In the running test for evaluation, as conditions for the setting of construction, the process speed was set at 94.2 mm/sec, the peripheral speed of the developing roller 2 was so set as to be 160.1 mm/sec and the peripheral speed of the toner feed roller 8 was set to be 120.0 mm/sec. The touch pressure of the developing blade 9 was so set as to be 25 g/cm in linear pressure. Under such conditions for the setting, the toner A held on the developing roller 2 was in a quantity of triboelectricity of −20 to −40 $\mu$C/g. Electric potential was so set that the photosensitive drum had a surface potential of −700 V as nonimage area potential (Vd) and −120 V as image area potential (Vl) at which the maximum toner image density was to be obtained. Also, the development high voltage (Vdc) applied to the developing roller 2 was set to be −370 V so that the contrast potential |Vl−Vdc| (Vcont) came to 250 V.

Using the above image-forming apparatus, an image having an image area percentage of 3% was continuously printed, and the densities of 2/16 multilevel image and 4/16 multilevel image in 16 gradation were measured at an interval of 1,000 sheets by the method described previously in Embodiments of the present invention. Character images were also printed, and whether or not any spots around line images occurred was visually evaluated.

The weight of the developing unit was also measured before and after the image formation to measure toner consumption. Still also, the fog toner having adhered to the surface of the photosensitive drum was sampled by picking it up with an adhesive tape, and the fog density was measured in the same manner as in Example 1. Each evaluation was made at a printing interval of 1,000 sheets, and finally the running test for evaluation was made on 5,000 sheets to obtain the results shown in Table 3. In Example 4, the ideal values of the 2/16 multilevel image density and 4/16 multilevel image density are 0.15 and 0.30, respectively.

A character pattern shown in FIG. 11A was printed on plain paper, where visual evaluation was made on any toner spots around line images (a condition shown in FIG. 11B) in the same manner as in Example 1.

As shown in Table 3, though the multilevel image densities were a little lower than the ideal densities, the photosensitive drum A of Example 4 maintained stable densities. At the same time, any spots around line images were not seen on character images throughout the running test for evaluation. Also, the fog was kept at a low density up to 5,000 sheets, and did not have any great influence on the toner consumption to cause no problems at all.

As described above, according to Example 4, when the electrostatic latent image formed by exposure to the laser light ON/OFF-controlled in accordance with image signals is formed into a visible image by the contact developing system in which the developing roller is brought into contact with the photosensitive drum at a stated pressure, the triboelectric series relationship between the toner particles and the external additive, constituting the negatively chargeable toner, and the charge transport layer which is the surface layer of the photosensitive drum is controlled to be in the order of the external additive, the toner particles and the surface layer of the photosensitive drum from the negative side. This enables the toner to be maintained to the regular negative charge polarity to prevent the toner's quantity of triboelectricity from lowering, even when the toner is rubbed with the photosensitive drum surface. Hence, the density gradation characteristics can be maintained in a good condition. Line-image latent images such as character images can also be formed into visible images using the toner in a proper quantity, so that the toner consumption can be prevented from increasing and at the same time the spots around line images can be prevented from occurring. Moreover, the reversal fog can also be prevented, and a lower running cost of the whole system and a longer service life of the developing unit can be achieved.

The photosensitive drum and toner as described above are used in Example 4. Without limitation thereto, any toner particles, external additive and charge transport layer which have the triboelectric charge characteristics that the triboelectric series relationship between them is in the order of the external additive, the toner particles and the surface layer of the photosensitive drum from the negative side may of course be used under appropriate selection.

In Example 4, a negatively chargeable toner is used as the toner and materials showing positive triboelectric charge characteristics with respect to the negatively chargeable toner particles and external additive each are used to form the charge transport layer. When, however, positively chargeable toner particles are used to produce the toner, a positively chargeable external additive may be selected and materials showing negative triboelectric charge characteristics with respect to the positively chargeable toner particles and positively chargeable external additive each may be used to form the charge transport layer of the photosensitive drum, whereby the toner's quantity of triboelectricity can be kept from lowering according to the like principle described above, and the effect stated above can be obtained.

A photosensitive drum may also be used which is further provided with a protective layer superposed on the charge transport layer so that the photosensitive drum is durable to wear and scratches occurring on the surface upon friction. For example, 100 parts by weight of antimony-containing fine tin oxide particles having an average particle diameter of 0.02 $\mu$m, 100 parts by weight of a curable acrylic monomer, 0.1 part by weight of 2-methylthioxanthone as a photopolymerization initiator and 300 parts by weight of toluene were dispersed for 96 hours by means of a sand mill to prepare a liquid preparation for protective layer. This protective-layer liquid preparation may be applied by spraying, on the charge transport layer of the photosensitive drum A, followed by drying. Thereafter, the coating thus formed is exposed to ultraviolet radiations by means of a high-pressure mercury lamp for 20 seconds at a light intensity of 80 mW/cm$^2$ to form a protective layer of 5 $\mu$m in layer thickness. Such a photosensitive drum may also be used. Where the protective layer is provided, a photosensitive drum strong to wear and scratching can be obtained. Hence, the photosensitive drum can be improved in running performance and an image-forming apparatus having achieved a much lower running cost can be provided.

Comparative Example 2

In Comparative Example 2, a charge transport layer serving as the surface layer of the photosensitive drum was produced according to the following formulation.

10 parts by weight of polycarbonate resin and 10 parts by weight of a triarylamine compound represented by the above Formula (I) were dissolved in 40 parts by weight of monochlorobenzene and 20 parts by weight of dichloromethane to obtain a charge transport layer intermediate coating solution. Next, 15 parts by weight of a dispersion prepared by dispersing 120 parts by weight of monochlorobenzene, 30 parts by weight of polytetrafluoroethylene particles and 1.8 parts by weight of a comb-type fluorine graft polymer by means of a ball mill was added to the charge transport layer intermediate coating solution to make up a charge transport layer coating fluid.

On the measuring-object support plate 204 of the device for measuring the quantity of triboelectricity shown in FIG. 7, a charge transport layer coating fluid was applied as the measuring object 207, followed by drying. Using the toner particles A and external additive A as the contacting powder 202, the triboelectric charge characteristics of the charge transport layer in this Comparative Example 2 with respect to the toner particles A and external additive A each were examined. As the result, the charge transport layer used in Comparative Example 2 showed negative charge with respect to the toner particles A upon its friction, and showed positive charge characteristics with respect to the external additive A upon its friction. Namely, the triboelectric series relationship between them was in the order of the external additive A, the charge transport layer and the toner particles A from the negative side.

The charge transport layer coating fluid was applied by dipping, on a cylinder prepared in the same manner as in Example 1 on which the subbing layer and the charge generation layer had been superposed, followed by drying at 110° C. for 1 hour to form a 24 $\mu$m thick charge transport layer. Thus, a multilayer type electrophotographic photosensitive member was produced. This electrophotographic photosensitive member is designated as photosensitive drum B. The surface layer of the photosensitive drum B was in negative charge polarity with respect to the negatively chargeable toner A.

A running test for evaluation was made in the same manner as in Example 1 except for using this photosensitive drum B and the toner A. Results obtained are shown in Table 3.

As shown in Table 3, in Comparative Example 2, the densities of 2/16 multilevel image and 4/16 multilevel image increased with progress of the running for evaluation, until the multilevel image densities became much higher than the ideal densities when printed on 5,000 sheets. Also, the spots around line images of character images came to greatly occur with progress of the running for evaluation. Also, the fog density became higher by three to four times that in the case of Example 4, and, as an influence thereof, the toner consumption became higher, until the toner was consumed in excess in a quantity corresponding to that for about 1,000 sheets when printed on 5,000 sheets, compared with that in Example 4.

In Comparative Example 2, the multilevel image density, toner consumption and fog density in the running test for evaluation shifted in substantially the same manner as those in Example 4 from the initial stage up to 2,000-sheet printing. Hence, it is presumed that in the initial stage of the running test for evaluation the external additive A negatively charged by the surface of the photosensitive drum B have covered the toner particles A to keep the toner A have the regular negative charge characteristics. However, with repeated operation of the developing unit, the external additive A have gradually come off from the toner particles A or have become buried in surface portions of the toner particles A, so that it has become difficult to attain the negative charge characteristics of the external additive A and further the toner particles A have positively been charged by the surface of the photosensitive drum B to cause a decrease in the quantity of triboelectricity, thus bringing about difficulties in the multilevel image density, toner consumption and fog density, as so considered.

Example 5

In Example 5, a photosensitive drum A produced in the same manner as in Example 1 was used as the image-bearing member. As the negatively chargeable toner, a negatively chargeable toner was used which was obtained by externally adding to 100 parts by weight of the toner particles A described in Example 4, 1.3 parts by weight of hydrophobic fine titanium oxide powder (hereinafter "external additive B") obtained by surface-treating 100 parts by weight of titanium oxide having a specific surface area of 110 m$^2$/g, with 17 parts by weight of isobutyltrimethoxysilane. This negatively chargeable toner is designated as toner B.

Using the device for measuring the quantity of triboelectricity shown in FIG. 7, the charge characteristics of the external additive B with respect to the photosensitive drum A and the toner particles A each were examined. As the result, the external additive B showed negative charge upon its friction with the charge transport layer of the photosensitive drum A, and showed positive charge characteristics with respect to the toner particles A. Namely, the triboelectric series relationship between them was in the order of the toner particles A, the external additive B and the surface layer of the photosensitive drum A from the negative side. Also, the surface layer of the photosensitive drum A was in positive charge polarity with respect to the negatively chargeable toner B.

The toner B was supplied to a process cartridge of Laser Jet 4050, manufactured by Hewlett Packard Co., having been remodeled to be able to form images by the contact developing system like that in Example 4 and also its photosensitive drum was replaced with the photosensitive drum A. Using this image-forming apparatus, an evaluation running test of 5,000 sheet printing was made in the same manner as in Example 4. An image having an image area percentage of 3% was continuously printed, and the densities of 2/16 multilevel image and 4/16 multilevel image in 16 gradation were measured at an interval of 1,000 sheets. Character images were also printed, and whether or not any spots around line images occurred was visually evaluated. Also, the weight of the developing unit was measured before and after the image formation to measure toner consumption. Still also, the fog toner having adhered to the surface of the photosensitive drum was sampled by picking it with an adhesive tape, and the fog density was measured. Each evaluation was made at a printing interval of 1,000 sheets, and finally the running test for evaluation was made on 5,000 sheets to obtain the results shown in Table 4. In the present Example, the ideal values of the 2/16 multilevel image density and 4/16 multilevel image density are 0.15 and 0.30, respectively.

As shown in Table 4, in Example 5, though the multilevel image densities were a little lower than the ideal densities, stable densities were maintained. At the same time, any spots around line images were not seen on character images throughout the running test for evaluation. Also, the fog was kept at a low density up to 5,000 sheets, and did not have any great influence on the toner consumption to cause no problems at all.

As described above, according to Example 5, the triboelectric series relationship between the toner particles and the external additive, constituting the negatively chargeable toner, and the charge transport layer which is the surface layer of the photosensitive drum is controlled to be in the order of the toner particles, the external additive and the surface layer of the photosensitive drum from the negative side. This enables the toner to be maintained to the regular negative charge polarity to prevent the toner's quantity of triboelectricity from lowering, even when the toner is rubbed with the photosensitive drum surface. Hence, the density gradation characteristics can be maintained in a good condition. Line-image latent images such as character images can also be formed into visible images using the toner in a proper quantity, so that the toner consumption can be prevented from increasing and at the same time the spots around line images can be prevented from occurring. Moreover, the reversal fog can also be prevented, and a lower running cost of the whole system and a longer service life of the developing unit can be achieved.

The photosensitive drum and toner as described above are used in Example 5. Without limitation thereto, any toner particles, external additive and charge transport layer which have the triboelectric charge characteristics that the triboelectric series relationship between them is in the order of the toner particles, the external additive and the surface layer of the photosensitive drum from the negative side may of course be used under appropriate selection.

In Example 5, a negatively chargeable toner is used as the toner and materials showing positive triboelectric charge characteristics with respect to the negatively chargeable toner particles and external additive each are used to form the charge transport layer. When, however, positively chargeable toner particles are used to produce the toner, a positively chargeable external additive may be selected and materials showing negative triboelectric charge characteristics with respect to the positively chargeable toner particles and positively chargeable external additive each may be used to form the charge transport layer of the photosensitive drum, whereby the toner's quantity of triboelectricity can alike be kept from lowering, and the effect stated above can be obtained.

Comparative Example 3

In Comparative Example 3, a running test for evaluation was conducted in the same manner as in Example 5 except for using the photosensitive drum B as the image-bearing member.

The triboelectric charge characteristics of the charge transport layer, the surface layer of the photosensitive drum B, with respect to the toner particles A and external additive B were examined in the following way: On the measuring-object support plate 204 shown in FIG. 7, a charge transport layer coating fluid for the photosensitive drum B was applied as the measuring object 207, followed by drying. Using the toner particles A and external additive B as the contacting powder 202, the triboelectric charge characteristics of the charge transport layer of the photosensitive drum B with respect to the toner particles A and external additive B each were examined. As the result, the charge transport layer used in Comparative Example 3 showed negative charge with respect to both the toner particles A and the external additive B. Also, the triboelectric series relationship between the external additive B and the toner particles A was in the order of the toner particles A and the external additive B from the negative side. Hence, the triboelectric series relationship was in the order of the charge transport layer, the toner particles A and the external additive B from the negative side. Also, the surface layer of the photosensitive drum B was in negative charge polarity with respect to the negatively chargeable toner B.

The results of evaluation are shown in Table 4. In Comparative Example 3, the densities of multilevel images both became higher with progress of the running test for evaluation, and the fog density was high from the beginning. As an influence thereof, the toner consumption became higher, until the toner run short in the course of printing on 2,000 to 3,000 sheets to become unable to continue the evaluation test any longer. This was presumably because the toner particles A and external additive B became positively charged by the surface of the photosensitive drum B, so that the regular negative charge characteristics became no longer obtainable as the toner. Also, the spots around line images of character images came to occur greatly with progress of the running test for evaluation.

Example 6

In Example 6, a photosensitive drum A produced in the same manner as in Example 1 was used as the image-bearing member. As the negatively chargeable toner, a negatively chargeable toner was used which was obtained by externally adding to 100 parts by weight of the toner particles A described in Example 4, 1 part by weight of titanium oxide (hereinafter "external additive C") having a primary particle diameter of 200 nm. This negatively chargeable toner is designated as toner C.

Like the foregoing Examples, using the device for measuring the quantity of triboelectricity shown in FIG. 7, the charge characteristics of the external additive C with respect to the photosensitive drum A and the toner particles A each were examined. As the result, the external additive C showed positive charge upon its friction with the charge transport layer of the photosensitive drum A, and showed positive charge characteristics also with respect to the toner particles A. As in Example 4, the triboelectric series relationship of the toner A and the surface layer of the photosensitive drum A was in the order of the toner particles A and the surface layer of the photosensitive drum A from the negative side. Thus, the triboelectric series relationship inclusive of the external additive C was in the order of the toner particles A, the surface layer of the photosensitive drum A and the external additive C from the negative side. Also, the surface layer of the photosensitive drum A was in positive charge polarity with respect to the negatively chargeable toner C.

A running test for evaluation was made in the same manner as in Example 4. The results are shown in Table 5.

In Example 6, the ideal values of the 2/16 multilevel image density and 4/16 multilevel image density are 0.15 and 0.30, respectively.

As shown in Table 5, in Example 6 the multilevel images were kept at stable densities having values substantially close to the ideal densities. At the same time, any spots around line images were not seen on character images throughout the running test for evaluation. Also, the fog, though increased slightly on 5,000 th sheet, was kept at a low density up to 4,000 sheets, and did not have any great influence on the toner consumption to cause no problems at all. This is because the toner particles A was negatively charged upon its friction with the surface of the photosensitive drum A and on other hand the external additive C was positively charged upon its friction with the surface of the photosensitive drum A, where the external additive thus positively charged acted as if it was what is called the carrier in two-component development systems, so that the toner particles A were further negatively charged, as so presumed.

As described above, according to Example 6, the triboelectric series relationship between the toner particles and the external additive, constituting the negatively chargeable toner, and the charge transport layer which is the surface layer of the photosensitive drum is controlled to be in the order of the toner particles, the surface layer of the photosensitive drum and the external additive from the negative side. This enables the toner particles to be maintained to the regular negative charge polarity to prevent the quantity of the toner triboelectricity from lowering, even when the toner is rubbed with the photosensitive drum surface. Hence, the density gradation characteristics can be maintained in a good condition. Line-image latent images such as character images can also be formed into visible images using the toner in a proper quantity, so that the toner consumption can be prevented from increasing and at the same time the spots around line images can be prevented from occurring. Moreover, the reversal fog can also be prevented, and a lower running cost of the whole system and a longer service life of the developing unit can be achieved.

The photosensitive drum and toner as described above are used in Example 6. Without limitation thereto, any toner particles, external additive and charge transport layer which have the triboelectric charge characteristics that the triboelectric series relationship between them is in the order of the toner particles, the surface layer of the photosensitive drum and the external additive from the negative side may of course be used under appropriate selection.

In Example 6, a toner was used to which external additive was added alone. The external additive used in the present Example may also be used in combination with an additional external additive having the triboelectric charge characteristics with respect to the surface layer of the photosensitive drum as described in Examples 4 and 5, and the like effect can be obtained.

Comparative Example 4

In Comparative Example 4, a running test for evaluation was conducted in the same manner as in Example 6 except for using the photosensitive drum B as the image-bearing member.

The triboelectric charge characteristics of the charge transport layer, the surface layer of the photosensitive drum B, with respect to the external additive C were examined in the following way: On the measuring-object support plate 204 shown in FIG. 7, a charge transport layer coating fluid for the photosensitive drum B was applied as the measuring object 207, followed by drying. Using the external additive C as the contacting powder 202, the triboelectric charge characteristics of the charge transport layer in Comparative Example 4 with respect to the external additive C were examined. As a result, the charge transport layer used in Comparative Example 4 showed negative charge with respect to the external additive C. The triboelectric series relationship between the charge transport layer and the toner particles A used in the toner C was, as described in Comparative Example 2, in the order of the charge transport layer and the toner particles A from the negative side. Also, as in Example 6, the triboelectric series relationship between the external additive C and the toner particles A was in the order of the toner particles A and the external additive C from the negative side. Hence, the triboelectric series relationship inclusive of the external additive C was in the order of the charge transport layer, the toner particles A and the external additive C from the negative side. Also, the surface layer of the photosensitive drum B was in negative charge polarity with respect to the negatively chargeable toner C.

The results of evaluation are shown in Table 5. In Comparative Example 4, the densities of multilevel images both became higher immediately after the start of the running test for evaluation, and the fog density was high from the beginning. As an influence thereof, the toner consumption became higher, until the toner run short in the course of printing on 2,000 to 3,000 sheets to become unable to continue the evaluation test any longer. This was presumably because the toner particles A and external additive C became positively charged by the surface of the photosensitive drum B, so that the regular negative charge characteristics became no longer obtainable as the toner. Also, the spots around line images of character images occurred greatly, immediately after the start of the running test for evaluation.

Example 7

In Example 7, a photosensitive drum A produced in the same manner as in Example 1 was used as the image-bearing member. As the negatively chargeable toner, a negatively chargeable toner was used which was obtained by externally adding to 100 parts by weight of the toner particles A described in Example 4, 1 part by weight of hydrophobic fine silica powder (hereinafter "external additive D") obtained by surface-treating 100 parts by weight of silica having a specific surface area of 130 $m^2/g$, with 5 parts by weight of isobutyltrimethoxysilane. This negatively chargeable toner is designated as toner D.

Like the foregoing Examples, using the device for measuring the quantity of triboelectricity shown in FIG. 7, the charge characteristics of the external additive D with respect to the photosensitive drum A and the toner particles A each were examined. As a result, the external additive D showed negative charge upon its friction with the charge transport layer of the photosensitive drum A, and showed negative charge characteristics also with respect to the toner particles A. Also, as in Example 4, the triboelectric series relationship of the toner A and the surface layer of the photosensitive drum A was in the order of the toner particles A and the surface layer of the photosensitive drum A from the negative side. Thus, the triboelectric series relationship inclusive of the external additive D was in the order of the external additive D, the toner particles A and the surface layer of the photosensitive drum A from the negative side. Also, the surface layer of the photosensitive drum A was in positive charge polarity with respect to the negatively chargeable toner D.

The toner D was supplied to a process cartridge of Laser Jet 4050, manufactured by Hewlett Packard Co., having been remodeled to be able to form images by the contact developing system like that in Example 4 and also its photosensitive drum was replaced with the photosensitive drum A. Using this image-forming apparatus, an evaluation running test of 5,000 sheet printing was made in the same manner as in Example 1.

Results obtained are shown in Table 6. In Example 7, the ideal values of the 2/16 multilevel image density and 4/16 multilevel image density are the same as those in Example 4, i.e., 0.15 and 0.30, respectively.

As shown in Table 6, in Example 7, though the multilevel image densities were a little lower than the ideal densities, stable densities were maintained. At the same time, any spots around line images were not seen on character images throughout the running test for evaluation. Also, the fog was kept at a low density up to 5,000 sheets, and did not have any great influence on the toner consumption to cause no problems at all.

As described above, according to Example 7, the triboelectric series relationship between the toner particles and the external additive, constituting the negatively chargeable toner, and the charge transport layer which is the surface layer of the photosensitive drum is controlled to be in the order of the external additive, the toner particles and the surface layer of the photosensitive drum from the negative side. This enables the toner to be maintained to the regular negative charge polarity to prevent the toner's quantity of triboelectricity from lowering, even when the toner is rubbed with the photosensitive drum surface. Hence, the density gradation characteristics can be maintained in a good condition. Line-image latent images such as character images can also be formed into visible images using the toner in a proper quantity, so that the toner consumption can be prevented from increasing and at the same time the spots around line images can be prevented from occurring. Moreover, the reversal fog can also be prevented, and a lower running cost of the whole system and a longer service life of the developing unit can be achieved.

Comparative Example 5

In Comparative Example 5, a running test for evaluation was conducted in the same manner as in Example 7 except for using the photosensitive drum B as the image-bearing member.

The triboelectric charge characteristics of the charge transport layer, the surface layer of the photosensitive drum B, with respect to the external additive D were examined in the following way: On the measuring-object support plate 204 shown in FIG. 7, a charge transport layer coating fluid for the photosensitive drum B was applied as the measuring object 207, followed by drying. Using the external additive D as the contacting powder 202, the triboelectric charge characteristics of the charge transport layer in Comparative Example 5 with respect to the external additive D were examined. As the result, the charge transport layer used in Comparative Example 5 showed negative charge with respect to the external additive D. The triboelectric series relationship between the charge transport layer and the toner particles A used in the toner D was, as described in Comparative Example 2, in the order of the charge transport layer and the toner particles A from the negative side. Also, as in Example 7, the triboelectric series relationship between the external additive D and the toner particles A was in the order of the external additive D and the toner particles A from the negative side. Hence, the triboelectric series relationship inclusive of the external additive D was in the order of the charge transport layer, the external additive D and the toner particles A from the negative side. Also, the surface layer of the photosensitive drum B was in negative charge polarity with respect to the negatively chargeable toner D.

The results of evaluation are shown in Table 6. In Comparative Example 5, the densities of gradational images both became higher with progress of the running test for evaluation, and the fog density was high from the beginning. As an influence thereof, the toner consumption became higher, until the toner runs short in the course of printing on 2,000 to 3,000 sheets to become unable to continue the evaluation test any longer. This was presumably because the toner particles A and external additive D became positively charged by the surface of the photosensitive drum B, so that the regular negative charge characteristics became no longer obtainable as the toner. Also, the spots around line images of character images occurred greatly with progress of the running test for evaluation.

As having been described above, in the present invention, when images are formed by the contact developing system in which the toner-carrying member is brought into contact with the image-bearing member at a stated pressure, the triboelectric series relationship between the image-bearing member (photosensitive drum 1) surface layer and the toner particles and the external additive, constituting the negatively chargeable toner, is controlled to be in the order of (a) the external additive, the toner particles and the surface layer of the image-bearing member (photosensitive drum 1), (b) the toner particles, the external additive and the surface layer of the image-bearing member or (c) the toner particles, the surface layer of the image-bearing member and the external additive, from the negative side. This enables the toner to be maintained to the regular charge polarity to prevent the quantity of the toner triboelectricity from lowering, even when the toner is rubbed with the image-bearing member surface. Also, an image-forming apparatus can be provided which can well maintain the density gradation characteristics to form images (visible toner images) stably in the step of developing electrostatic latent images formed by exposing an image-bearing member to light modulated m accordance with image signals which is emitted from an exposure unit while varying its exposure area. Also, images free of spots around line images can be formed, and still also any excess toner consumption can be prevented. Moreover, the reversal fog can also be prevented even in long-term continuous service of the image-forming apparatus.

In a toner to which two or more types of external additives are used in combination, at least one of the external additives must satisfy the relationship of any of the above (a), (b) and (c), whereby the like effect can be obtained.

In the case when a positively chargeable toner is used in the image-forming apparatus of the present invention, the triboelectric series relationship between the image-bearing member (photosensitive drum) surface layer and the toner particles and the external additive, constituting the positively chargeable toner, is controlled to be in the order of (a) the external additive, the toner particles and the surface layer of the image-bearing member (photosensitive drum 1), (b) the toner particles, the external additive and the surface layer of the image-bearing member or (c) the toner particles, the surface layer of the image-bearing member and the external additive, from the positive side, whereby the same effect as the above can be obtained.

TABLE 1

| | Printed on: | | | | | |
|---|---|---|---|---|---|---|
| | Initial stage | 1,000th sheet | 2,000th sheet | 3,000th sheet | 4,000th sheet | 5,000th sheet |
| Photosensitive drum A (Example 1) | | | | | | |
| 2/16 Multi-level image density: | 0.14 | 0.12 | 0.12 | 0.12 | 0.13 | 0.13 |
| 4/16 Multi-level image density: | 0.26 | 0.24 | 0.25 | 0.25 | 0.26 | 0.25 |
| Spots around line images: | A | A | A | A | A | A |
| Toner consumption: (g) | 0.0 | 12.8 | 27.3 | 42.4 | 57.6 | 73.3 |
| Fog density: | 1.4 | 3.2 | 4.2 | 4.0 | 4.1 | 3.8 |
| Photosensitive drum B (Comparative Example 1) | | | | | | |
| 2/16 Multi-level image density: | 0.16 | 0.19 | 0.22 | 0.26 | 0.28 | 0.30 |
| 4/16 Multi-level image density: | 0.30 | 0.36 | 0.42 | 0.48 | 0.49 | 0.50 |
| Spots around line images: | A | A | B | C | C | C |
| Toner consumption: (g) | 0.0 | 16.8 | 36.8 | 56.4 | 76.4 | 101.8 |
| Fog density: | 2 | 12.0 | 13.1 | 13.5 | 13.9 | 15.0 |

TABLE 2

| | Printed on: | | | | | |
|---|---|---|---|---|---|---|
| | Initial stage | 1,000th sheet | 2,000th sheet | 3,000th sheet | 4,000th sheet | 5,000th sheet |
| Photosensitive drum C (Example 2) | | | | | | |
| 2/16 Multi-level image density: | 0.14 | 0.13 | 0.13 | 0.12 | 0.13 | 0.14 |
| 4/16 Multi-level image density: | 0.25 | 0.25 | 0.26 | 0.26 | 0.25 | 0.25 |
| Spots around line images: | A | A | A | A | A | A |
| Toner consumption: (g) | 0.0 | 12.7 | 27.1 | 42.3 | 57.7 | 73.9 |
| Fog density: | 1 | 3.1 | 3.9 | 4.1 | 4.1 | 4.0 |

TABLE 3

| | Toner used: Toner A | | | | | |
|---|---|---|---|---|---|---|
| | Printed on: | | | | | |
| | Initial stage | 1,000th sheet | 2,000th sheet | 3,000th sheet | 4,000th sheet | 5,000th sheet |
| Photosensitive drum A (Example 4) | | | | | | |
| 2/16 Multi-level image density: | 0.13 | 0.13 | 0.12 | 0.13 | 0.13 | 0.13 |

TABLE 3-continued

| | Toner used: Toner A | | | | | |
|---|---|---|---|---|---|---|
| | Printed on: | | | | | |
| | Initial stage | 1,000th sheet | 2,000th sheet | 3,000th sheet | 4,000th sheet | 5,000th sheet |
| 4/16 Multi-level image density: | 0.25 | 0.25 | 0.26 | 0.25 | 0.24 | 0.25 |
| Spots around line images: | A | A | A | A | A | A |
| Toner consumption: (g) | 0.0 | 12.6 | 27.2 | 42.0 | 57.0 | 72.8 |
| Fog density: | 0.7 | 2.3 | 2.5 | 3.6 | 3.8 | 3.6 |
| Photosensitive drum B (Comparative Example 2) | | | | | | |
| 2/16 Multi-level image density: | 0.15 | 0.15 | 0.20 | 0.25 | 0.25 | 0.28 |
| 4/16 Multi-level image density: | 0.26 | 0.27 | 0.38 | 0.40 | 0.46 | 0.46 |
| Spots around line images: | A | A | B | C | C | C |
| Toner consumption: (g) | 0.0 | 12.5 | 31.3 | 50.1 | 69.2 | 88.9 |
| Fog density: | 1.0 | 3.0 | 6.7 | 13.0 | 13.7 | 14.5 |

TABLE 4

| | Toner used: Toner B | | | | | |
|---|---|---|---|---|---|---|
| | Printed on: | | | | | |
| | Initial stage | 1,000th sheet | 2,000th sheet | 3,000th sheet | 4,000th sheet | 5,000th sheet |
| Photosensitive drum A (Example 5) | | | | | | |
| 2/16 Multi-level image density: | 0.13 | 0.13 | 0.12 | 0.14 | 0.13 | 0.12 |
| 4/16 Multi-level image density: | 0.26 | 0.25 | 0.25 | 0.24 | 0.26 | 0.25 |
| Spots around line images: | A | A | A | A | A | A |
| Toner consumption: (g) | 0.0 | 12.9 | 27.4 | 42.6 | 57.8 | 74.0 |
| Fog density: | 1.6 | 3.3 | 4.5 | 4.6 | 4.0 | 4.2 |
| Photosensitive drum B (Comparative Example 3) | | | | | | |
| 2/16 Multi-level image density: | 0.22 | 0.35 | 0.35 | — | — | — |
| 4/16 Multi-level image density: | 0.45 | 0.67 | 0.60 | — | — | — |
| Spots around line images: | B | C | C | — | — | — |
| Toner consumption: (g) | 0.0 | 47.2 | 105.2 | — | — | — |
| Fog density: | 15.1 | 16.2 | 16.9 | — | — | — |

TABLE 5

| | Toner used: Toner C | | | | | |
|---|---|---|---|---|---|---|
| | Printed on: | | | | | |
| | Initial stage | 1,000th sheet | 2,000th sheet | 3,000th sheet | 4,000th sheet | 5,000th sheet |
| Photosensitive drum A (Example 6) | | | | | | |
| 2/16 Multi-level image density: | 0.14 | 0.14 | 0.13 | 0.15 | 0.14 | 0.19 |
| 4/16 Multi-level image density: | 0.29 | 0.31 | 0.32 | 0.35 | 0.32 | 0.36 |
| Spots around line images: | A | A | A | A | A | A |
| Toner consumption: (g) | 0.0 | 13.5 | 28.6 | 44.2 | 60.5 | 80.2 |
| Fog density: | 3.0 | 3.5 | 4.7 | 5.0 | 6.2 | 8.5 |
| Photosensitive drum B (Comparative Example 4) | | | | | | |
| 2/16 Multi-level image density: | 0.42 | 0.45 | 0.50 | — | — | — |
| 4/16 Multi-level image density: | 0.72 | 0.76 | 0.86 | — | — | — |
| Spots around line images: | C | C | C | — | — | — |
| Toner consumption: (g) | 0.0 | 50.6 | 109.6 | — | — | — |
| Fog density: | 16.2 | 18.5 | 20.6 | — | — | — |

TABLE 6

| | Toner used: Toner D | | | | | |
|---|---|---|---|---|---|---|
| | Printed on: | | | | | |
| | Initial stage | 1,000th sheet | 2,000th sheet | 3,000th sheet | 4,000th sheet | 5,000th sheet |
| Photosensitive drum A (Example 7) | | | | | | |
| 2/16 Multi-level image density: | 0.12 | 0.13 | 0.12 | 0.12 | 0.13 | 0.13 |
| 4/16 Multi-level image density: | 0.26 | 0.25 | 0.26 | 0.25 | 0.26 | 0.25 |
| Spots around line images: | A | A | A | A | A | A |
| Toner consumption: (g) | 0.0 | 12.5 | 24.3 | 42.1 | 57.2 | 73.0 |
| Fog density: | 0.7 | 2.4 | 2.6 | 3.5 | 3.9 | 3.8 |
| Photosensitive drum B (Comparative Example 6) | | | | | | |
| 2/16 Multi-level image density: | 0.21 | 0.30 | 0.30 | — | — | — |
| 4/16 Multi-level image density: | 0.42 | 0.59 | 0.61 | — | — | — |
| Spots around line images: | B | C | C | — | — | — |
| Toner consumption: (g) | 0.0 | 46.5 | 102.9 | — | — | — |
| Fog density: | 14.2 | 15.9 | 15.5 | — | — | — |

What is claimed is:

1. An image-forming apparatus comprising:

an image-bearing member for holding thereon an electrostatic latent image;

charging means for electrostatically charging a surface layer of said image-bearing member;

an exposure unit for forming the electrostatic latent image on said image-bearing member by exposing said image-bearing member to light, said image bearing member having been charged by said charging means; and a developing unit, which includes a toner-carrying member for carrying and transporting a negatively-chargeable toner thereon, said toner-carrying member being brought into contact with said image-bearing member to form a developing zone where the toner is made to electrically adhere to the electrostatic latent image formed on said image-bearing member, to render the electrostatic latent image visible to form a toner image, wherein in a triboelectric series relationship formed between the toner and said surface layer of said image-bearing member, said surface layer of said image-bearing member has a charge polarity which is a different polarity with respect to a charge polarity of the toner in the developing unit, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

2. The apparatus according to claim 1, wherein the toner is negatively chargeable, and in the triboelectric series relationship formed between the toner and said surface layer of said image-bearing member, said surface layer of said image-bearing member has a charge polarity, which is a positive charge polarity with respect to a charge polarity of the toner.

3. The apparatus according to claim 1, wherein said surface layer of said image-bearing member is a charge transport layer.

4. The apparatus according to claim 1, wherein said surface layer of said image-bearing member is a protective layer.

5. The apparatus according to claim 1, wherein the toner is a nonmagnetic toner.

6. The apparatus according to claim 1, wherein the electrostatic latent image is a digital latent image.

7. The apparatus according to claim 1, wherein the electrostatic latent image is a digital latent image having a multilevel area.

8. The apparatus according to claim 1, wherein the toner includes toner particles and at least one external additive.

9. The apparatus according to claim 8, wherein in the triboelectric series relationship of the toner particles, the external additive and said surface layer of the developing blade are disposed in the order of the external additive, the toner particles, and said surface layer of said image-bearing member from the negative side.

10. The apparatus according to claim 8, wherein in the triboelectric series relationship of the toner particles, the external additive, and said surface layer of said developing blade are disposed in the order of the toner particles, the external additive, and said surface layer of said image-bearing member from the negative side.

11. An image-forming apparatus comprising:

an image-bearing member for holding thereon an electrostatic latent image;

charging means for electrostatically charging a surface of said image-bearing member;

an exposure unit for forming the electrostatic latent image on said image-bearing member by exposing the image-bearing member to light, said image bearing member having been charged by said charging means; and a plurality of developing units for developing electrostatic latent images with toners of different colors;

wherein each of said plurality of developing units include a toner-carrying member for carrying and transporting thereon a negatively chargeable toner having a different color, a toner-carrying member of one developing unit selected from said plurality of developing units being brought into contact with said image-bearing member to form a developing zone where the toner is made to electrically adhere to the electrostatic latent image formed on said image-bearing member to render the electrostatic latent image visible, wherein each of said plurality of developing units are operated sequentially to form multi-color toner images, wherein in a triboelectric series relationship formed between the toner and a surface layer of said image-bearing member in each of said plurality of developing units, said surface layer has a charge polarity, which is a different polarity with respect to a charge polarity of each toner in each of said plurality of said developing units, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

12. The apparatus according to claim 11, wherein said surface layer of said image-bearing member is a charge transport layer.

13. The apparatus according to claim 11, wherein said surface layer of said image-bearing member is a protective layer.

14. The apparatus according to claim 11, wherein the toner is a nonmagnetic toner.

15. The apparatus according to claim 11, wherein the electrostatic latent image is a digital latent image.

16. The apparatus according to claim 11, wherein the electrostatic latent image is a digital latent image having a multilevel area.

17. The apparatus according to claim 11, wherein the toner includes toner particles and at least one external additive.

18. The apparatus according to claim 17, wherein in the triboelectric series relationship of the toner particles, the external additive, and said surface layer of said developing blade are disposed in the order of the external additive, the toner particles, and said surface layer of said image-bearing member from the negative side.

19. The apparatus according to claim 17, wherein in the triboelectric series relationship of the toner particles, the external additive, and said surface layer of said developing blade are disposed in the order of the toner particles, the external additive, and said surface layer of said image-bearing member from the negative side.

20. A process cartridge, which is detachably mountable on a main body of an image-forming apparatus for forming a fixed image by developing with a toner an electrostatic latent image to form a toner image, and transferring the toner image to a transfer medium, followed by fixing, said process cartridge comprising:

an image-bearing member for holding thereon the image;

a developing unit, which includes a toner-carrying member for carrying and transporting a negatively chargeable toner thereon, said toner-carrying member being brought into contact with said image-bearing member to form a developing zone where the toner is made to electrically adhere to the electrostatic latent image formed on said image-bearing member, to render the electrostatic latent image visible to form a toner image; and at least one of a means selected from a group consisting of:

(a) charging means for electrostatically charging a surface of said image-bearing member;

(b) an exposure unit for forming the electrostatic latent image on said image-bearing member by exposing said image-bearing member to light, said image bearing member having been charged;

(c) transfer means for transferring the toner image formed by said developing unit to a transfer medium; and (d) cleaning means for removing a toner remaining on said image-bearing member after the toner image has been transferred to the transfer medium, said cleaning means being integrally supported with said image-bearing member and said developing unit, wherein in a triboelectric series relationship formed between the toner and a surface layer of the image-bearing member, said surface layer of said image-bearing member having a charge polarity, which is a different polarity with respect to a charge polarity of the toner in said developing unit, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

21. The process cartridge according to claim 20, wherein the toner is negatively chargeable, and in the triboelectric series relationship formed between said toner and said surface layer of said image-bearing member, said surface layer of said image-bearing member has a charge polarity, which is a positive charge polarity with respect to a charge polarity of the toner.

22. The process cartridge according to claim 20, wherein said surface layer of said image-bearing member is a charge transport layer.

23. The process cartridge according to claim 20, wherein said surface layer of said image-bearing member is a protective layer.

24. The process cartridge according to claim 20, wherein the toner is a nonmagnetic toner.

25. The process cartridge according to claim 20, wherein the electrostatic latent image is a digital latent image.

26. The process cartridge according to claim 20, wherein the electrostatic latent image is a digital latent image having a multilevel area.

27. The process cartridge according to claim 20, wherein the toner includes toner particles and at least one external additive.

28. The process cartridge according to claim 27, wherein in the triboelectric series relationship of the toner particles, the external additive, and the surface layer of the developing blade are disposed in the order of the external additive, the toner particles, and said surface layer of the image-bearing member from the negative side.

29. The process cartridge according to claim 27, wherein in the triboelectric series relationship of the toner particles, the external additive, and said surface layer of said developing blade are disposed in the order of the toner particles, the external additive, and said surface layer of said image-bearing member from the negative side.

30. The process cartridge according to claim 20, wherein the toner image is transferred to the transfer medium via an intermediate transfer member.

31. The process cartridge according to claim 20, wherein the toner image is directly transferred to the transfer medium without using an intermediate transfer member.

32. An image-forming apparatus comprising:

an image-bearing member for holding thereon an electrostatic latent image;

an exposure unit for forming the electrostatic latent image on said image-bearing member by exposing said image-bearing member to light; and a developing unit, which includes a toner-carrying member for carrying and transporting thereon a negatively chargeable toner including toner particles and at least one external additive, said toner-carrying member being brought into contact with said image-bearing member to form a developing zone where the toner is made to electrically adhere to the electrostatic latent image formed on said image-bearing member to render the electrostatic latent image visible to form a toner image;

wherein in a triboelectric series relationship formed between a surface layer of said image-bearing member, the toner particles, and the external additive are disposed in the order of the external additive, the toner particles, and said surface layer of said image-bearing member from the negative side, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

33. The apparatus according to claim 32, wherein said surface layer of said image-bearing member is a charge transport layer.

34. The apparatus according to claim 32, wherein said surface layer of said image-bearing member is a protective layer.

35. The apparatus according to claim 32, wherein the toner is a nonmagnetic toner.

36. The apparatus according to claim 32, wherein the electrostatic latent image is a digital latent image.

37. The apparatus according to claim 32, wherein the electrostatic latent image is a digital latent image having a multilevel area.

38. The apparatus according to claim 32, wherein, in the triboelectric series relationship formed between the toner and said surface layer of said image-bearing member, said surface layer of said image-bearing member has a charge polarity, which is a different polarity with respect to a charge polarity of the toner in said developing unit.

39. An image-forming apparatus comprising:

an image-bearing member for holding thereon an electrostatic latent image;

an exposure unit for forming the electrostatic latent image on said image-bearing member by exposing said image-bearing member to light; and a developing unit, which includes a toner-carrying member for carrying and transporting thereon a negatively chargeable toner having toner particles and at least one external additive, said toner-carrying member being brought into contact with said image-bearing member to form a developing zone where the toner is made to electrically adhere to the electrostatic latent image formed on said image-bearing member to render the electrostatic latent image visible to form a toner image, wherein in a triboelectric series relationship formed between a surface layer of said image-bearing member, the toner particles, and the external additive are disposed in the order of the toner particles, the external additive, and said surface layer of said image-bearing member from the negative side, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

40. The apparatus according to claim 39, wherein said surface layer of said image-bearing member is a charge transport layer.

41. The apparatus according to claim 39, wherein said surface layer of said image-bearing member is a protective layer.

42. The apparatus according to claim 39, wherein the toner is a nonmagnetic toner.

43. The apparatus according to claim 39, wherein the electrostatic latent image is a digital latent image.

44. The apparatus according to claim 39, wherein the electrostatic latent image is a digital latent image having a multilevel area.

45. The apparatus according to claim 39, wherein in the triboelectric series relationship formed between the toner and said surface layer of said image-bearing member, said surface layer of said image-bearing member has a charge polarity, which is a different polarity with respect to a charge polarity of the toner in said developing unit.

46. An image-forming apparatus comprising:

an image-bearing member for holding thereon an electrostatic latent image;

an exposure unit for forming the electrostatic latent image on said image-bearing member by exposing said image-bearing member to light; and a developing unit, which includes a toner-carrying member for carrying and transporting thereon a negatively, chargeable toner, said toner including toner particles and at least one external additive, said toner-carrying member being brought into contact with said image-bearing member to form a developing zone where the toner is made to electrically adhere to the electrostatic latent image formed on said image-bearing member to render the electrostatic latent image visible to form a toner image;

wherein in a triboelectric series relationship formed between a surface layer of said image-bearing member, the toner particles, and the external additive are disposed in the order of the toner particles, said surface layer of the image-bearing member, and the external additive from the negative side, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

47. The apparatus according to claim 46, wherein said surface layer of said image-bearing member is a charge transport layer.

48. The apparatus according to claim 46, wherein said surface layer of said image-bearing member is a protective layer.

49. The apparatus according to claim 46, wherein the toner is a nonmagnetic toner.

50. The apparatus according to claim 46, wherein the electrostatic latent image is a digital latent image.

51. The apparatus according to claim 46, wherein the electrostatic latent image is a digital latent image having a multilevel area.

52. The apparatus according to claim 46, wherein in the triboelectric series relationship formed between the toner and said surface layer of said image-bearing member, said surface layer of said image-bearing member has a charge polarity, which is a different polarity with respect to a charge polarity of the toner in said developing unit.

53. A process cartridge, which is detachably mountable to a main body of an image-forming apparatus for forming a fixed image by developing with a toner an electrostatic latent image to form a toner image, and transferring the toner image to a transfer medium, followed by fixing, said process cartridge comprising:

an image-bearing member for holding thereon the electrostatic latent image;

a developing unit, which includes a toner-carrying member for carrying and transporting thereon a negatively chargeable toner, said toner including toner particles and at least one external additive, said toner-carrying member being brought into contact with said image-bearing member to form a developing zone where the toner is made to electrically adhere to the electrostatic latent image formed on said image-bearing member, to render the electrostatic latent image visible to form a toner image; and at least one of a means selected from the group consisting of:

(a) charging means for electrostatically charging a surface of the image-bearing member;

(b) an exposure unit for forming the electrostatic latent image on said image-bearing member by exposing said image-bearing member to light, said image bearing member having been charged;

(c) transfer means for transferring the toner image formed by said developing unit, to the transfer medium; and (d) cleaning means for removing toner remaining on said image-bearing member after the toner image has been transferred to the transfer medium, said cleaning means being integrally supported with said image-bearing member and said developing unit, wherein in a triboelectric series relationship formed between a surface layer of the image-bearing member, the toner particles, and the external additive being in the order of the external additive, the toner particles, and said surface layer of said image-bearing member from the negative side, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

54. The process cartridge according to claim 53, wherein said surface layer of said image-bearing member is a charge transport layer.

55. The process cartridge according to claim 53, wherein said surface layer of said image-bearing member is a protective layer.

56. The process cartridge according to claim 53, wherein the toner is a nonmagnetic toner.

57. The process cartridge according to claim 53, wherein the electrostatic latent image is a digital latent image.

58. The process cartridge according to claim 53, wherein the electrostatic latent image is a digital latent image having a multilevel area.

59. The process cartridge according to claim 53, wherein in the triboelectric series relationship formed between the toner and said surface layer of said image-bearing member, said surface layer of said image-bearing member has a charge polarity, which is a different polarity with respect to a charge polarity of the toner in said developing unit.

60. The process cartridge according to claim 53, wherein the toner image is transferred to the transfer medium via an intermediate transfer member.

61. The process cartridge according to claim 53, wherein the toner image is directly transferred to the transfer medium without using an intermediate transfer member.

62. A process cartridge, which is detachably mountable to a main body of an image-forming apparatus for forming a fixed image by developing, with a toner, an electrostatic latent image to form a toner image, and transferring the toner image to a transfer medium, followed by fixing; said process cartridge comprising:

an image-bearing member for holding thereon the electrostatic latent image;

a developing unit, which includes a toner-carrying member for carrying and transporting thereon a negatively chargeable toner, said toner including toner particles and at least one external additive, said toner-carrying member being brought into contact with said image-bearing member to form a developing zone where the toner is made to electrically adhere the electrostatic latent image formed on said image-bearing member to render the electrostatic latent image visible to form a toner image; and at least one of a means selected from the group consisting of:

(a) charging means for charging a surface of said image-bearing member electrostatically;

(b) an exposure unit for forming the electrostatic latent image on said image-bearing member by exposing said image-bearing member to light, said image bearing member having been charged;

(c) transfer means for transferring the toner image formed by said developing unit to the transfer medium; and (d) cleaning means for removing a toner remaining on said image-bearing member after the toner image has been transferred to the transfer medium, said cleaning means being integrally supported with said image-bearing member and said developing unit;

wherein in a triboelectric series relationship formed between a surface layer of said image-bearing member, the toner particles, and the external additive are disposed in the order of the toner particles, the external additive, and said surface layer of said image-bearing member from the negative side, and wherein said image-bearing member having the electrostatic latent image has a surface potential, as a nonimage area potential (Vd) within a range of −500 to −800 V, and as an image area potential (Vl), at which the maximum toner image density is to be obtained, within a range of −50 to −200 V.

63. The process cartridge according to claim 62, wherein said surface layer of said image-bearing member is a charge transport layer.

64. The process cartridge according to claim 62, wherein said surface layer of said image-bearing member is a protective layer.

65. The process cartridge according to claim 62, wherein the toner is a nonmagnetic toner.

66. The process cartridge according to claim 62, wherein the electrostatic latent image is a digital latent image.

67. The process cartridge according to claim 62, wherein the electrostatic latent image is a digital latent image having a multilevel area.

68. The process cartridge according to claim 62, wherein in the triboelectric series relationship formed between the toner and said surface layer of said image-bearing member, said surface layer of said image-bearing member has a charge polarity, which is a different polarity with respect to a charge polarity of the toner in said developing unit.

69. The process cartridge according to claim 62, wherein the toner image is transferred to the transfer medium via an intermediate transfer member.

70. The process cartridge according to claim 62, wherein the toner image is directly transferred to the transfer medium without using an intermediate transfer member.

71. A process cartridge, which is detachably mountable to a main body of an image-forming apparatus for forming a fixed image by developing, with a toner, an electrostatic latent image to form a toner image, and transferring the toner image to a transfer medium, followed by fixing, said process cartridge comprising:

an image-bearing member for holding thereon the electrostatic latent image;

a developing unit, which includes a toner-carrying member for carrying and transporting thereon a negatively chargeable toner, said toner including toner particles and at least one external additive; said toner-carrying member being brought into contact with said image-bearing member to form a developing zone where the toner is made to electrically adhere to the electrostatic latent image formed on said image-bearing member to render the electrostatic latent image visible to form a toner image; and at least one of a means selected from a group consisting of:

(a) charging means for electrostatically charging a surface of said image-bearing member;

(b) an exposure unit for forming the electrostatic latent image on said image-bearing member by exposing said image-bearing member to light, said image bearing member having been charged;

(c) transfer means for transferring the toner image formed by said developing unit, to the transfer medium; and (d) cleaning means for removing a toner remaining on said image-bearing member after the toner image has been transferred to the transfer medium, said cleaning means being integrally supported with said image-bearing member and said developing unit;

wherein in a triboelectric series relationship formed between a surface layer of said image-bearing member, the toner particles, and the external additive are disposed in the order of the toner particles, said surface layer of said image-bearing member, and the external additive from the negative side, and wherein said image-bearing member having the electrostatic latent image has a surface potential, as an non-image area potential (Vd) within a range of −500 to −800 V, and as an image area potential (Vl), at which the maximum toner image density is to be obtained, within a range of −50 to −200 V.

72. The process cartridge according to claim 71, wherein said surface layer of said image-bearing member is a charge transport layer.

73. The process cartridge according to claims 71, wherein said surface layer of said image-bearing member is a protective layer.

74. The process cartridge according to claim 71, wherein the toner is a nonmagnetic toner.

75. The process cartridge according to claim 71, wherein the electrostatic latent image is a digital latent image.

76. The process cartridge according to claim 71, wherein the electrostatic latent image is a digital latent image having a multilevel area.

77. The process cartridge according to claim 71, wherein in the triboelectric series relationship formed between the toner and said surface layer of said image-bearing member, said surface layer of said image-bearing member has a charge polarity, which is a different polarity with respect to a charge polarity of the toner in said developing unit.

78. The process cartridge according to claim 71, wherein the toner image is transferred to the transfer medium via an intermediate transfer member.

79. The process cartridge according to claim 71, wherein the toner image is directly transferred to the transfer medium without using an intermediate transfer member.

* * * * *

UNITED STATES PATENT AND TRADEMARK OFFICE

CERTIFICATE OF CORRECTION

PATENT NO. : 6,647,230 B2
DATED : November 11, 2003
INVENTOR(S) : Tetsuya Kobayashi et al.

It is certified that error appears in the above-identified patent and that said Letters Patent is hereby corrected as shown below:

Column 2,
Lines 11and 31, “charges” should read -- charge --.

Column 3,
Line 32, “are a” should read -- is a --; and
Line 57, “becomes kept” should read -- is kept --.

Column 4,
Line 61, “unit as” should read -- uni is --.

Column 5,
Line 61, “wherein;” should read -- wherein, --.

Column 20,
Line 16, “a inorganic” should read -- an inorganic --.

Column 24,
Line 47, “state, m” should read -- state, in --.

Column 32,
Line 44, “described” should read -- described above, --.

Column 35,
Line 20, “also” should read -- also be --.

Column 46,
Line 43, “modulated m” should read -- modulated in --; and
Line 50, “toner to” should read -- toner --.

Column 49,
Line 54, “Example 6)” should read -- Example 5) --.

UNITED STATES PATENT AND TRADEMARK OFFICE

CERTIFICATE OF CORRECTION

PATENT NO. : 6,647,230 B2
DATED : November 11, 2003
INVENTOR(S) : Tetsuya Kobayashi et al.

It is certified that error appears in the above-identified patent and that said Letters Patent is hereby corrected as shown below:

Column 58,
Line 17, “as an” should read -- as a --; and
Line 26, “claims 71,” should read -- claim 71, --.

Signed and Sealed this

Twenty-second Day of June, 2004

JON W. DUDAS

*Acting Director of the United States Patent and Trademark Office*